US010675893B2

(12) United States Patent
Fujioka et al.

(10) Patent No.: US 10,675,893 B2
(45) Date of Patent: Jun. 9, 2020

(54) TAPE CASSETTE

(71) Applicant: BROTHER KOGYO KABUSHIKI KAISHA, Nagoya, Aichi (JP)

(72) Inventors: Atsushi Fujioka, Aichi (JP); Koichi Sugiura, Aichi (JP); Yoshihiro Ota, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 16/044,572

(22) Filed: Jul. 25, 2018

(65) Prior Publication Data

US 2019/0030930 A1 Jan. 31, 2019

(30) Foreign Application Priority Data

Jul. 31, 2017 (JP) ..... 2017-148370

(51) Int. Cl.
*B41J 15/04* (2006.01)
*B41J 17/36* (2006.01)

(52) U.S. Cl.
CPC ..... *B41J 15/044* (2013.01); *B41J 17/36* (2013.01)

(58) Field of Classification Search
CPC ..... B41J 13/00; B41J 13/0009; B41J 17/36; B41J 15/00; B41J 15/04; B41J 15/044; B41J 15/046
See application file for complete search history.

(56) References Cited

U.S. PATENT DOCUMENTS 9,290,011 B1 3/2016 Hojo et al.

FOREIGN PATENT DOCUMENTS

| | | | |
|---|---|---|---|
| CN | 105730015 | A | 7/2016 |
| EP | 1 813 431 | A1 | 1/2007 |
| EP | 1 813 431 | A1 | 8/2007 |
| EP | 2 295 254 | A1 | 3/2011 |
| JP | 2012-232462 | A | 11/2012 |

OTHER PUBLICATIONS

Extended European Search Report dated Dec. 14, 2018 from related EP 18185655.0.

*Primary Examiner* — Kristal Feggins
(74) *Attorney, Agent, or Firm* — Scully, Scott, Murphy & Presser, PC

(57) ABSTRACT

A tape cassette configured to contain a tape has a box-like cassette case having a wall formed with one of a recess and a hole, and a substrate having a first surface and a second surface opposite to the first surface, at least two conductive electrodes being provided to the first surface, a storage electrically connected to the pair of conductive electrodes being provided to the second surface. The at least one of the recess and the hole being arranged at a central area, in a particular direction, of the wall, and the substrate being attached on the wall such that the substrate is arranged at the one of the recess and the hole, and the at least two conductive electrodes are aligned in the particular direction regardless of whether the substrate is attached on the wall in a first orientation or a second orientation which is a reversed orientation with respect to the particular direction.

20 Claims, 15 Drawing Sheets

TAPE CASSETTE

CROSS-REFERENCE TO RELATED APPLICATIONS

This application claims priority under 35 U.S.C. § 119 from Japanese Patent Application No. 2017-148370 filed on Jul. 31, 2017. The entire subject matter of the application is incorporated herein by reference.

BACKGROUND

Technical Field

The present disclosures relate to a tape cassette.

Related Art

Conventionally, a tape cassette used for printing an image on a tape-like medium has been known. An example of a conventional tape cassette has a casing having a rectangular box shape, and containing tapes used for printing therein.

SUMMARY

Typically, a tape cassette accommodates a substrate having a storage configured to store information regarding the tape(s) accommodated therein is attached to the casing of the tape cassette so that a tape printer can retrieve the information stored in the storage of the substrate of the tape cassette loaded to the printer.

In such a tape cassette, it is necessary that the substrate is attached to the casing appropriately. That is, when a worker performs an operation to attach the substrate to the casing, if the substrate is oriented in a wrong direction, the substrate may not be attached to an outer wall of the casing of the tape cassette. Alternatively, although the substrate can be attached to the outer wall of the casing, if the substrate is oriented in a wrong direction, the tape printer may not retrieve the information stored in the substrate. Therefore, the worker is required to attach the substrate in a correct orientation with respect to the casing. Since the worker is required to pay attention to the orientation of the substrate with respect to the casing, workability tends to be lowered, and improvement in this respect has been desired.

According to aspects of the present disclosures, there is provided a tape cassette, having a box-like cassette case including a first outer wall, a second outer wall, a third outer wall, a fourth outer wall, a fifth outer wall and a sixth outer wall. The first outer wall and the second outer wall extend in parallel and are arranged in a first direction perpendicular to both the first outer wall and the second outer wall. The third outer wall and the fourth outer wall extend in parallel and are arranged in a second direction perpendicular to both the third outer wall and the fourth outer wall. The fifth outer wall and the sixth outer wall extend in parallel and are arranged in a third direction perpendicular to both the fifth outer wall and the sixth outer wall. The first direction, the third direction and the third direction are perpendicular to each other. A tape configured to be accommodated in the cassette case, and a substrate having a first surface and a second surface opposite to the first surface, two conductive electrodes are provided to the first surface. A storage electrically connected to the pair of conductive electrodes is provided to the second surface. The third outer wall has a first side wall extending in parallel with the third outer wall, one of a recess recessed in a fourth direction, which is a one-way direction of the second direction directing inward the cassette case from the third outer wall, and a hole penetrating the cassette case in the second direction, and a second side wall extending in parallel with the third outer wall, the first side wall, the one of the recess and the hole, and the second side wall extending, in this order, along a fifth direction which is one-way direction of the third direction, each of the pair of conductive electrodes being arranged in a sixth direction which is parallel with the first surface, given that the second surface is equally divided into three areas of a first substrate area, a second substrate area and a third substrate area along the one-way direction of the sixth direction, the storage being arranged in the second substrate area, the substrate being arranged to be bridged between the first side wall and the second side wall with the third direction being parallel to the sixth direction and a seventh direction opposite to the fourth direction being directed to the first surface, and one of the storage and a molded part protecting the storage being arranged at the one of the recess and the hole.

According to aspects of the present disclosures, there is provided a tape cassette configured to contain a tape, a box-like cassette case having a wall formed with one of a recess and a hole, and a substrate having a first surface and a second surface opposite to the first surface, at least two conductive electrodes being provided to the first surface, a storage electrically connected to the pair of conductive electrodes being provided to the second surface. The at least one of the recess and the hole are arranged at a central area, in a particular direction, of the wall. Further, the substrate being attached on the wall such that the substrate is arranged at the one of the recess and the hole, and the at least two conductive electrodes are aligned in the particular direction regardless of whether the substrate is attached on the wall in a first orientation or a second orientation which is a reversed orientation with respect to the particular direction.

According to the tape cassette as described above, since two conductive electrodes are arranged in the sixth direction, even if the substrate is arranged to be bridges between the first side wall and the second side wall with the one-way direction and the other-way direction of the sixth direction being reversed with respect to the third direction, the positional relationship between the two conductive electrodes remain unchanged. Since the storage or the molded part is attached to the recess or the hole, even if the substrate is arranged to be bridged between the first side wall and the second side wall with the one-way direction and the other-way direction of the sixth direction being reversed with respect to the third direction, the positional relationship of the storage with respect to the cassette case remains unchanged. Since the storage is arranged in the second substrate area, and the second substrate area includes the center of the second surface in the sixth direction, even if the substrate is arranged to be bridged between the first side wall and the second side wall with the one-way direction and the other-way direction of the sixth direction being reversed with respect to the third direction, the positional relationship between the pair of conductive electrodes with respect the cassette case hardly changes. Therefore, the worker can attach the substrate so as to be bridged between the first side wall and the second side wall even if the one-way and the other-way directions of the sixth direction being reversed with respect to the third direction, and it becomes unnecessary for the worker to check the one-way direction and the other-way direction of the sixth direction with respect to the third direction when attaching the substrate to the cassette case. Accordingly, the tape cassette configured as above can improve the workability when the worker attach the substrate to the cassette case.

BRIEF DESCRIPTION OF THE ACCOMPANYING DRAWINGS

DESCRIPTION OF THE ILLUSTRATIVE EMBODIMENT

Figure 1:
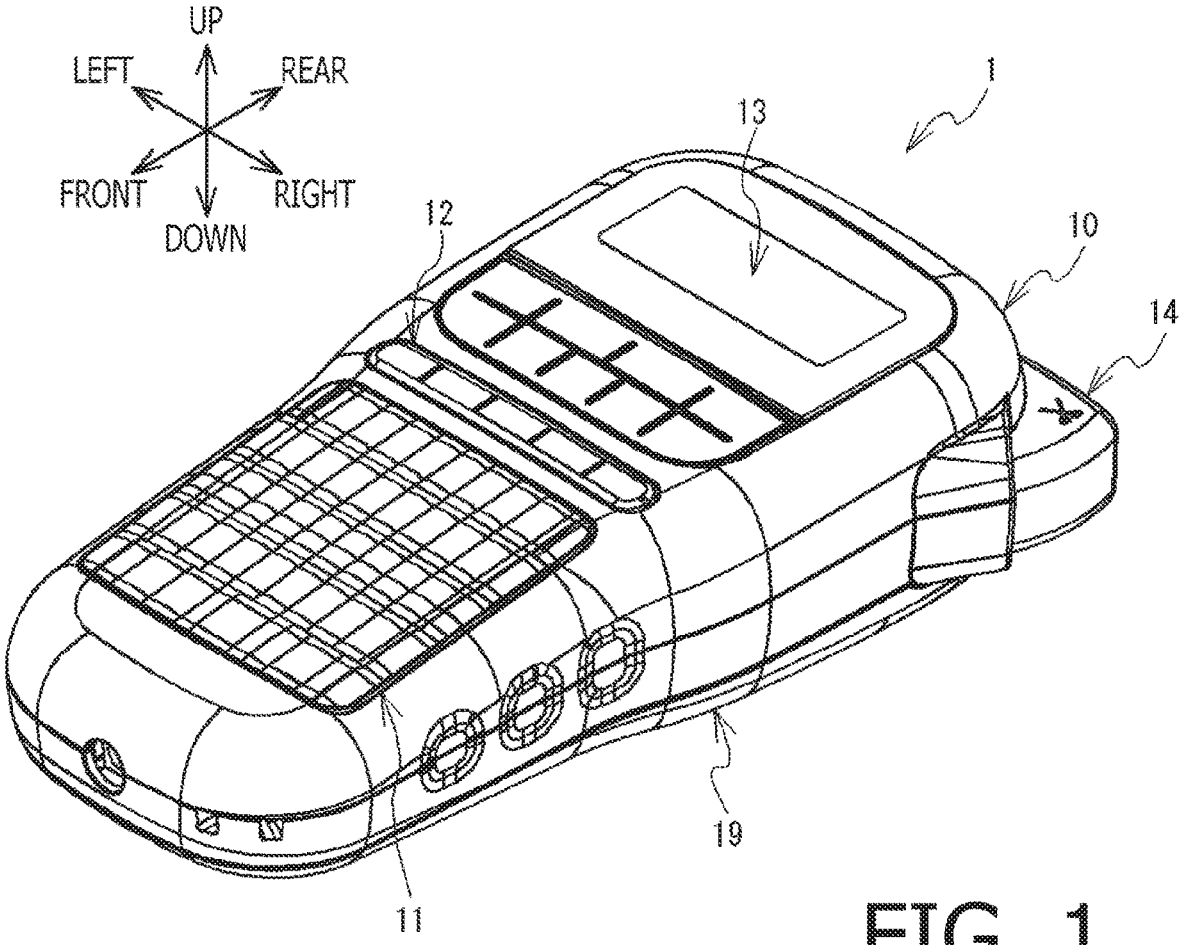
FIG. 1 is a perspective view, viewed from an upper right front side, of a printer according to an illustrative embodiment of the present disclosures.

Hereinafter, an illustrative embodiment of the present disclosures will be described referring to the accompanying drawings. It is noted that the drawings referred to hereinafter are for illustrating technical characteristics which can be employed according to the aspects of the present disclosures. Configurations of respective devices shown in the drawings are only examples and are not intended to limit the aspects of the present disclosures. It is noted that expressions "the same shapes" and "the same positions" in the following description are not intended to limit to "completely the same shapes" and "completely the same position," but are intended to include "substantially the same shapes" and "substantially the same positions," respectively. Similarly, the term "parallel" and "perpendicular (or orthogonal)" are not intended to limit to "accurately parallel" and "accurately perpendicular" but are intended to cover "substantially parallel" and "substantially perpendicular," respectively. Further, a term "direction" may include both a one-way direction and an opposite-way (the other-way) direction (e.g., an up-down direction, a right-left direction), or may simply mean only a one-way direction (e.g., an upper direction, a right-hand direction). Hereinafter, when the term "direction" is used to have the latter meaning, a term "one-way" or the "other-way" may occasionally be associated to emphasize that a particular direction (i.e., the "one-way" direction or the "other-way" direction) is referred to.

Firstly, an overall configuration of a printer 1 according to an illustrative embodiment of the present disclosures will be described, referring to FIGS. 1-3. In the following description, an upper left side, a lower right side, a lower left side, an upper right side, an upper side and a lower side of FIG. 1 will be defined as a left side, a right side, a front side, a rear side, an upper side and a lower side of the printer 1, respectively. According to the illustrative embodiment, the printer 1 is configured to use any one of various types of tape cassettes (e.g., a laminate type cassette, a receptor type cassette, a thermal type cassette, a tube type cassette). In the following description, an elongated recoding mediums accommodated in respective tape cassettes 5 (see FIG. 6) (e.g., a double-sided-adhesive tape 6, a film tape 7, a one-sided-adhesive tape, a heat-sensitive tape, a tube tape) will be collectively referred to as a "tape." The printer 1 is configured to perform a printing operation to print letters, characters and images on the tape.

The printer 1 has a substantially rectangular parallelepiped shape as shown in FIG. 1. The printer 1 has a casing 10 and a cover 19. On a front side of an upper surface of the casing 10, a keyboard 11 are provided. The keyboard 11 is used for inputting various characters/letters. On a rear side with respect to the keyboard 11, a function key group 12 is provided. The function key group 12 includes a power button and a print start button. Through the function key group 12, various instructions can be input to the printer 1. On the rear side with respect to the keyboard group 12, a liquid crystal display 13 is arranged. The liquid crystal display 13 displays the characters/letters input through the keyboard 11. The cover 19 is openably/closably attached to a lower side of the casing 10.

Figure 2:
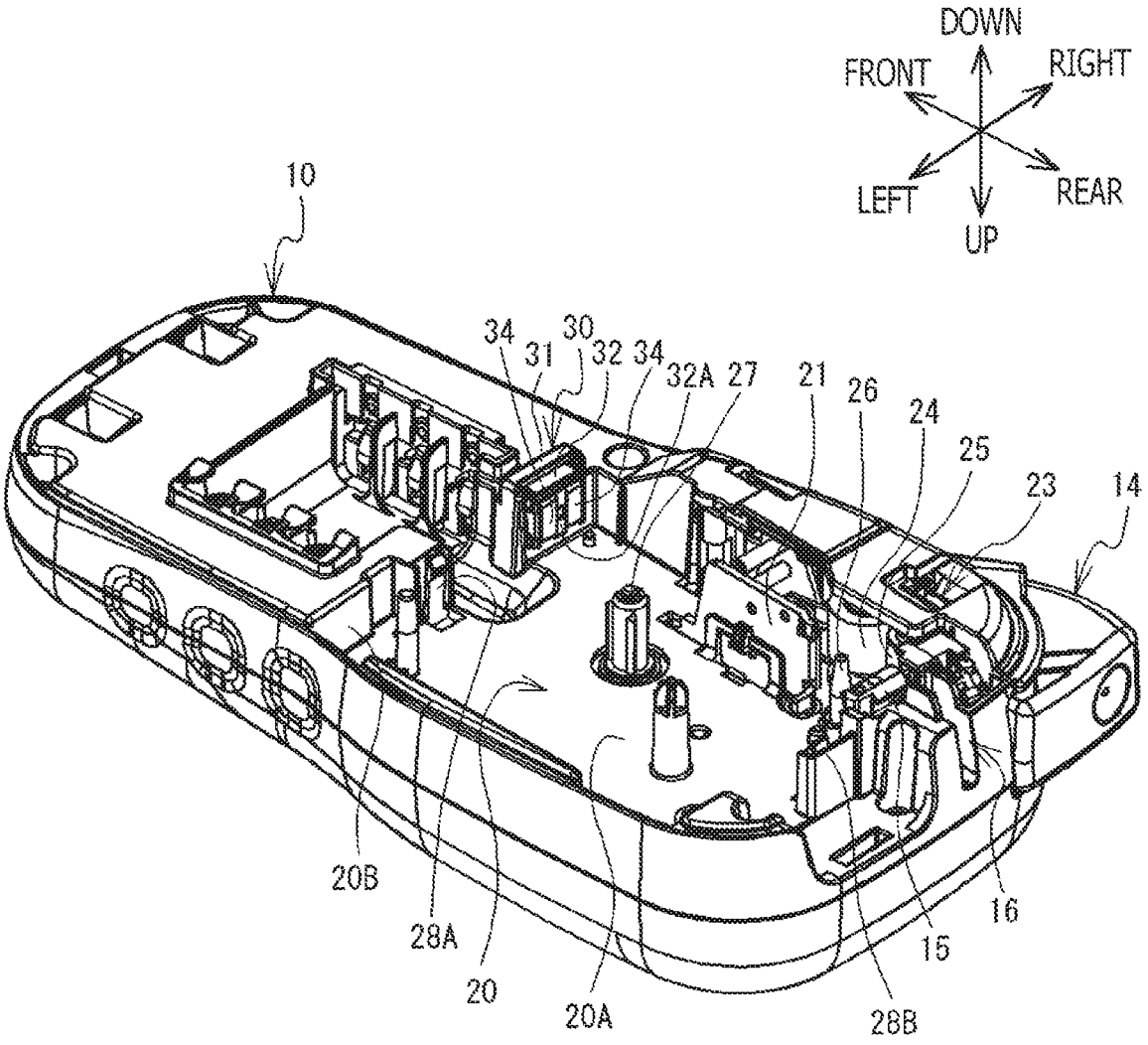
FIG. 2 is a perspective view of a casing of the printer viewed from a lower left rear side thereof.
Figure 3:
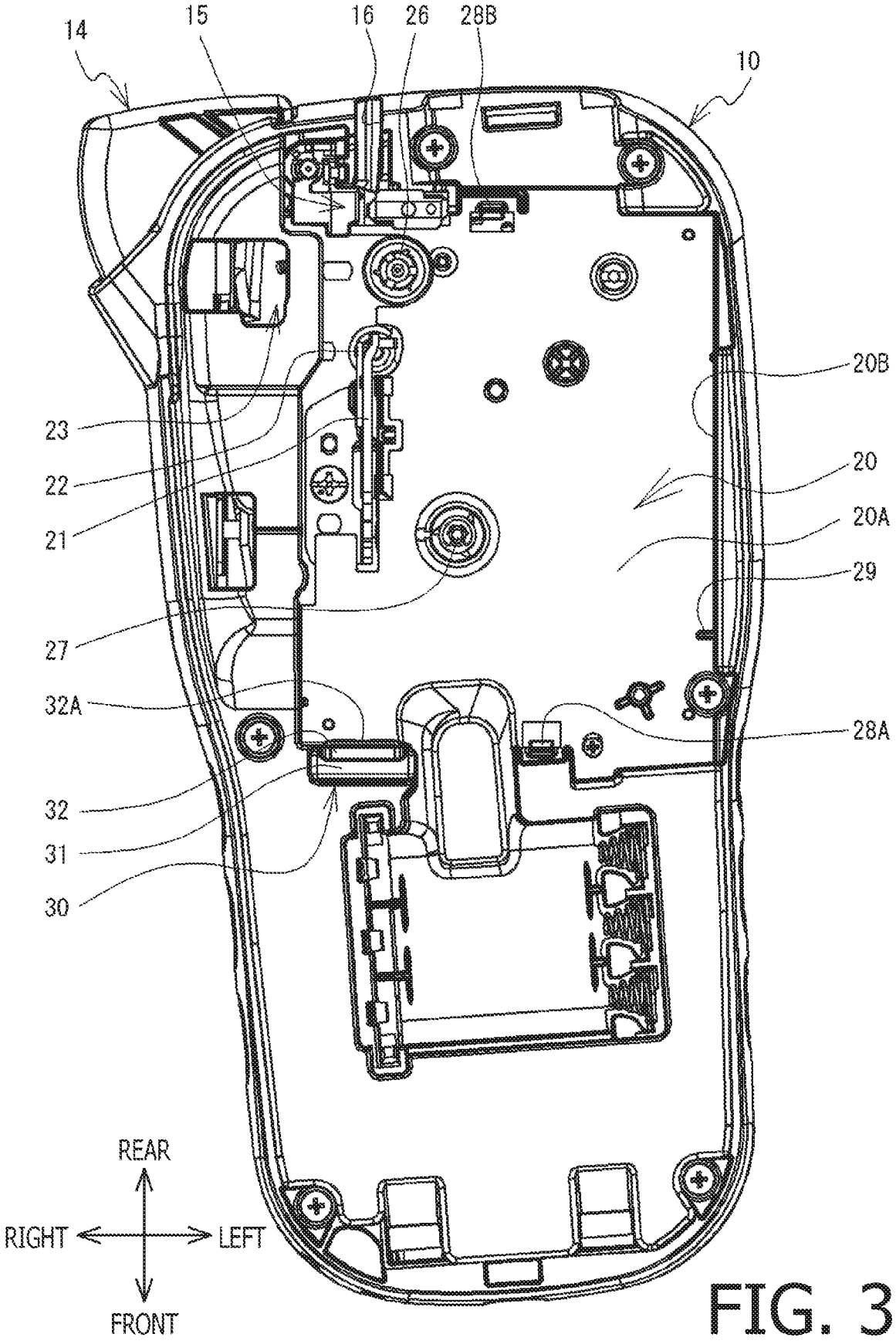
FIG. 3 is a bottom plan view of the casing of the printer.

As shown in FIGS. 2 and 3, the casing 10 is formed with a cassette attachment part 20. The cassette attachment part 20 is recessed upward from a lower surface of the casing 10, and has a bottom wall 20A and a side wall 20B. The bottom wall 20A has a substantially rectangular shape in downside plan view, and is perpendicular to the up-down direction. The side wall 20B extends downward from a periphery of the bottom wall 20A. The cassette attachment part 20 is formed such that the tape cassette 5 can be attached thereto and detached therefrom in the up-down direction.

In the cassette attachment part 20, a head holder 21, a platen holder 23, a tape driving shaft 26, a ribbon take-up shaft 27, hooks 28A and 28B, a rib 29 (see FIG. 3), and an electrode unit 30 are arranged. The head holder 21 is a plate-like member extending downward from a right portion of the bottom wall 20A. On a right side surface of the head holder 21, a thermal head 22 is arranged (see FIG. 3).

The platen holder 23 is arranged on a right portion of the cassette attachment part 20. The platen holder 23 is configured to be rotatable, about a front end portion thereof, in a substantially right-left direction. The platen holder 23 supports a platen roller 24 and a sub roller 25 such that each of the platen roller 24 and the sub roller 25 is rotatable in a counterclockwise direction in the downside plan view. The platen roller 24 is arranged to face the thermal head 22 from the right side. The sub roller 25 is arranged on the rear side and in the vicinity of the platen roller 24. The tape driving shaft 26 is arranged on the left side with respect to the sub roller 25, and extends downward from the bottom wall 20A. the ribbon take-up shaft 27 extends downward from a substantially central portion of the bottom wall 20A.

The hook 28A protrudes downward from a front end portion of the bottom wall 20A. The hook 28A is elastically deformable in the front-rear direction. The hook 28B protrudes downward from a rear end portion of the bottom wall 20A. The hook 28B is also elastically deformable in the front-rear direction. The rib 29 is arranged at a position on the front side with respect to the center, in the front-rear direction, of a left end portion of the cassette attachment part 20, and extends downward from the bottom wall 20A. A left end part of the rib 29 is connected to the side wall 20B. The electrode unit 30 is arranged at a right front corner of the side wall 20B.

On a right rear side of and in the vicinity of the tape driving shaft 26, a cutting device 15 is provided. At a right rear corner of the casing 10, an operation lever 14 is provided. The operation lever 14 is configured to be push-operated inward. In response to inward push-operation of the operation lever 14, the cutting device 15 is actuated to cut the tape located at a cutting position. On the rear side with respect to the cutting device 15, a tape discharge port 16 is formed. The tape discharge port 16 is a through opening which penetrates the casing 10 in the front-rear direction. The tape discharge port 16 allows a portion of the tape cut out by the cutting device 15 (which may be a printed portion of the tape) to be discharged outside the casing 10.

The printer 1 has a controller (not shown) inside the casing 10. The controller includes a CPU, a ROM, a RAM and the like, and controls the printing operation of the printer 1.

Figure 4:
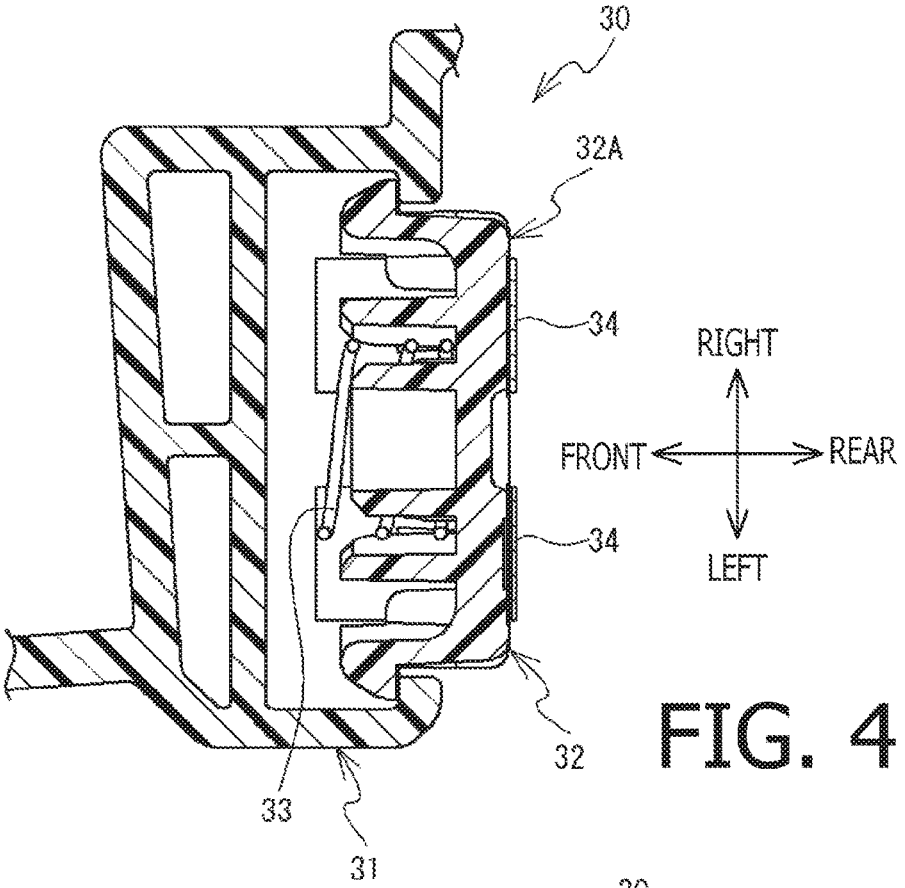
FIG. 4 is a cross-sectional view of an electrode unit taken along a plane perpendicular to an up-down direction when an electrode holder is located at a first position.
Figure 5:
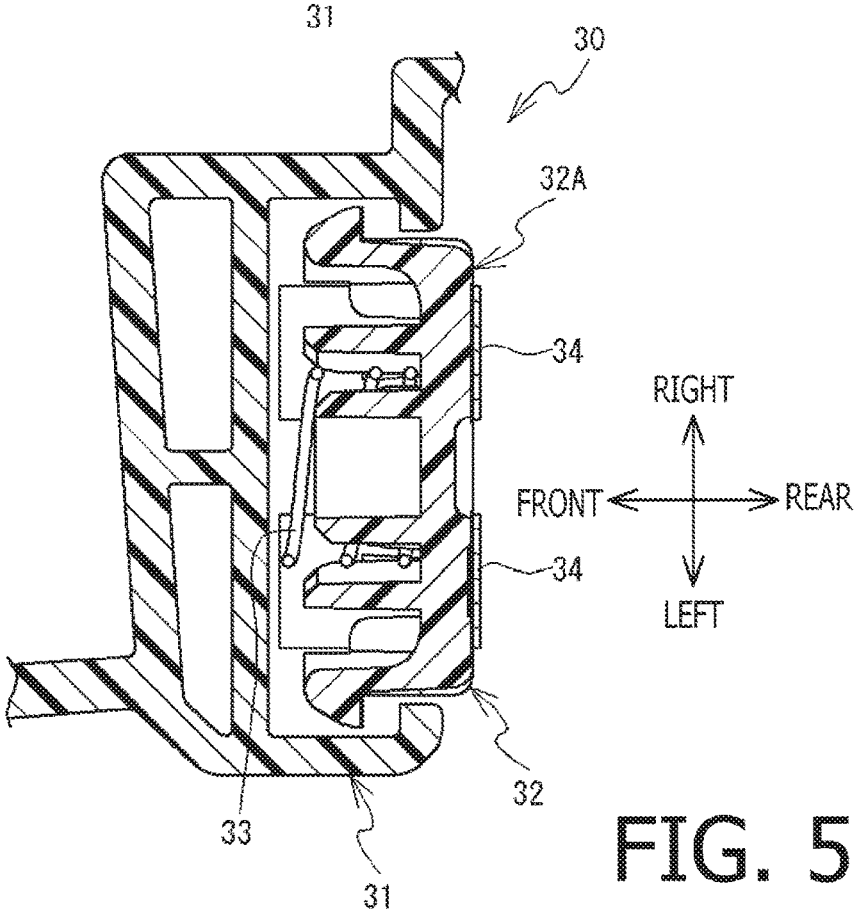
FIG. 5 is a cross-sectional view of the electrode unit taken along a plane perpendicular to the up-down direction when the electrode holder is located at a second position.

The electrode unit 30 will be described in detail, referring to FIGS. 2, 4 and 5. As shown in FIGS. 4 and 5, the electrode unit 30 has a holder support 31, an electrode holder 32 and an urging member 33. The holder support 31 is fixedly secured to the side wall 20B (see FIG. 2). The holder support 31 is a substantially rectangular parallelepiped shape box, and is opened rearward. The electrode holder 32 is a substantially rectangular parallelepiped shape box, and is opened frontward. The electrode holder 32 is arranged inside the holder support 31, and supported, by the holder support 31, so as to be movable in the front-rear direction between a first position (see FIG. 4) and a second position (see FIG. 5). When located at the first position, the electrode holder 32 protrudes rearward from a surface directed rearward of the side wall 20B (see FIG. 4). When located at the second position, the electrode holder 32 slightly protrudes rearward from the surface directed rearward of the side wall 20B (see FIG. 5). The protruding amount of the electrode holder 32 with respect to the surface directed rearward of the side wall 20B is smaller in the second position (see FIG. 5) than in the first position (see FIG. 4).

As shown in FIG. 2, a rear part of an upper end portion of the electrode holder 32 is inclined in oblique upper rear direction. A rear surface of the electrode holder 32 (hereinafter, referred to an electrode surface 32A) has a rectangular shape. On the electrode surface 32A, a pair of (i.e., two) main body side conductive electrodes 34 are provided. Each of the pair of main body side conductive electrodes 34 is a metallic electrode, and is electrically connected to the controller of the printer 1 through a harness (not shown). The main body side conductive electrodes 34 are arranged in the right and left direction with a particular clearance therebetween. Each of the main body side conductive electrodes 34 has a rectangular shape elongated in the up-down direction, and the two conductive electrodes 34 have the same shape. Upper ends of the two main body side conductive electrodes 34 are located at the same position in the up-down direction. Lower ends of the two main body side conductive electrodes 34 are located at the same position in the up-down direction.

As shown in FIGS. 4 and 5, the urging member 33 is a coil spring. One end of the urging member 33 is fixedly secured to the holder support 31, while the other end of the urging member 33 is fixedly secured to a surface (a front surface of the electrode holder 32) which is opposite to the electrode surface 32A of the electrode holder 32. The urging member 33 is configured to urge the electrode holder 32 rearward so as to move in a direction from the second position (see FIG. 5) to the first position (see FIG. 4).

Figure 6:
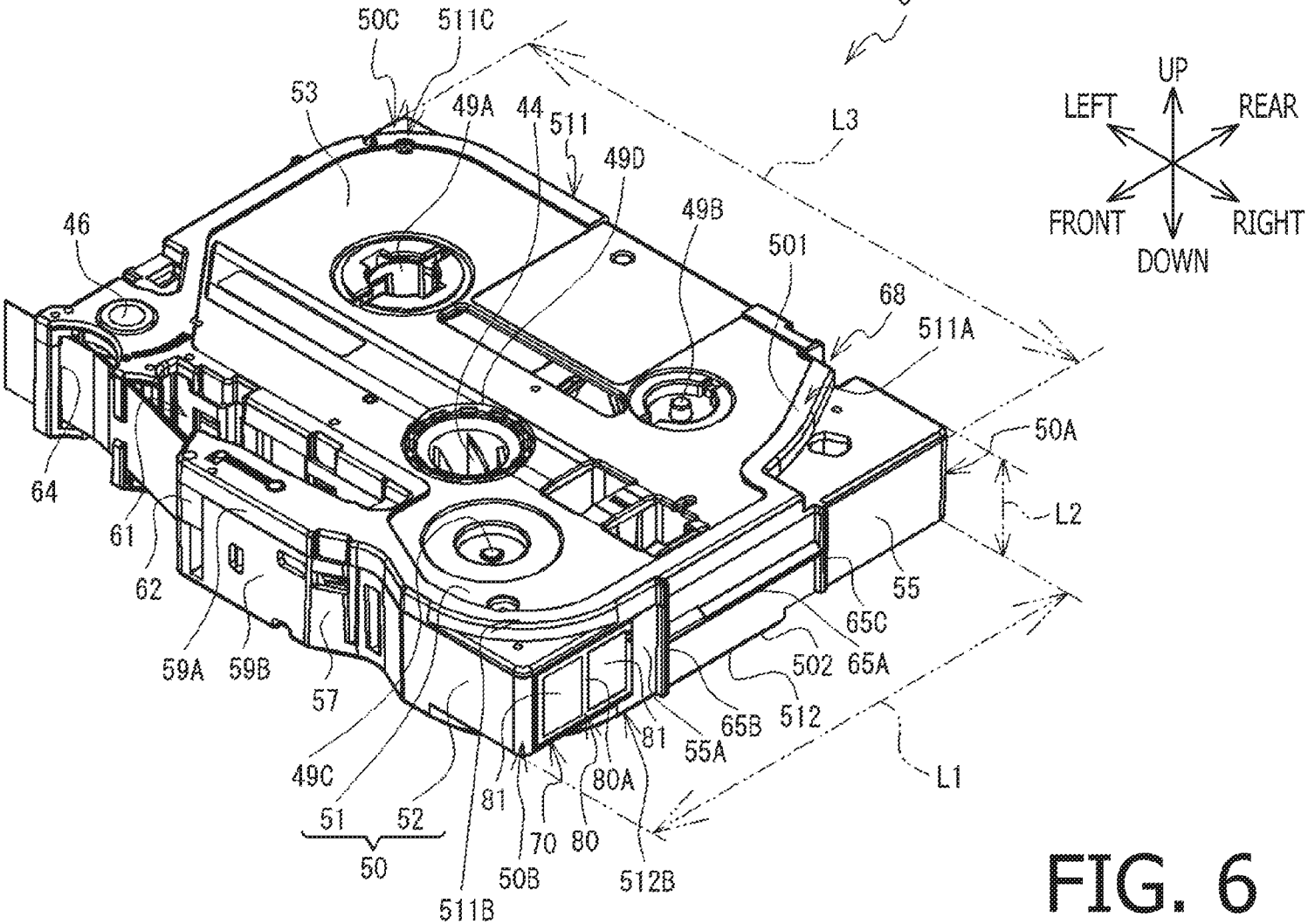
FIG. 6 is a perspective view of a tape cassette viewed from an upper right front side thereof.

Next, the tape cassette 5 will be described in detail, referring to FIGS. 6-11. In the following description, an upper left side, a lower right side, a lower left side, an upper right side, an upper side and a lower side in FIG. 6 will be defined as a left side, a right side, a front side, a rear side, an upper side, a lower side of the tape cassette 5, respectively. As shown in FIG. 6, the tape cassette 5 has a cassette case 50. The cassette case 50 has a substantially rectangular parallelepiped box shape, and has an upper case 51 and a lower case 52. The upper case 51 and the lower case 52 are arranged in the up-down direction, the upper case 51 being attached on the upper side of the lower case 51. The upper case 51 has an upper wall 53 and a peripheral wall 59A. The lower case 52 has a lower wall 54 (see FIG. 7A) and a peripheral wall 59B. Each of the upper wall 53 and the lower wall 54 extends in both the front-rear direction and the right-left direction. The lower wall 54 is arranged below the upper wall 53 with being aligned thereto.

The peripheral wall 59A extends downward from a periphery of the upper wall 53. The peripheral wall 59B extends upward from a periphery of the lower wall 54. The peripheral walls 59A and 59B form, in a state where the upper case 51 is coupled to the lower case 52, a right wall 55, a left wall 56, a front wall 57 and a rear wall 58 (see FIG. 7A). Each of the right wall 55 and the left wall 56 extends in both the front-rear direction and the up-down direction. The left wall 56 is arranged on the left side with respect to the right wall 55. Each of the front wall 57 and the rear wall 58 extends in both the up-down direction and the right-left direction. The rear wall 58 is arranged on the rear side with respect to the front wall 57.

The upper wall 53, the lower wall 54, the right wall 55, the left wall 56, the front wall 57 and the rear wall 58 are outer walls each facing inside the cassette case 50. A distance L1 between the front wall 56 and the rear wall 57 is larger than a distance L2 between the upper wall 53 and the lower wall 54. A distance L3 between the right wall 55 and the left wall 56 is larger than the distance L1 (see FIG. 6).

Figure 7A:
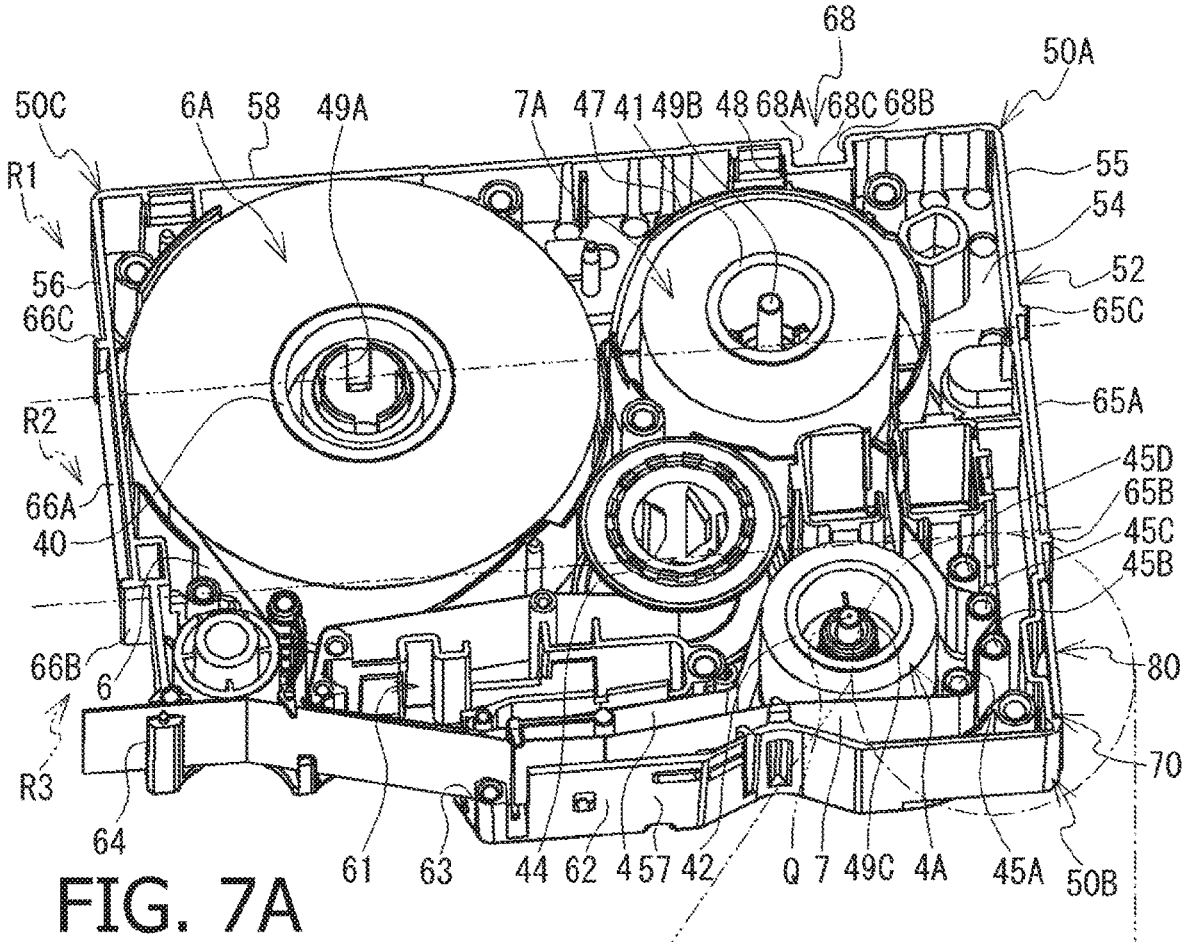
FIG. 7A is a perspective view of a laminate type tape cassette with an upper case being removed.

As shown in FIG. 7A, a head insertion part 61 is formed on the front wall 57. The head insertion part 61 is configured such that a portion of the front wall 57 is recessed rearward from the vicinity of the left end of the front wall 57 and extends rightward. A portion of the front wall 57 extending on the front side with respect to the head insertion part 61 will be referred to as an arm part 62. On a left end portion of the arm part 62, a first discharge port 63 is formed. The first discharge port 63 is an opening extending in the up-down direction, and the tape and an ink ribbon 4 are discharged, through the first discharge port 63, from inside to outside of the cassette case 50.

A second discharge port 64 is formed on the left wall 56 at a front end part thereof. In the following description, each of the right wall 55 and the left wall 56 is equally divided in the front-rear direction into three areas, which will be referred to as a first area R1, a second area R2 and a third area R3 in an order from the rear side to the front side. The second discharge port 64 is located, within the third area R3, on a downstream side, in a tape conveying direction, with respect to the first discharge port 63. The second discharge port 64 is an opening extending in the up-down direction. A portion of the tape discharged externally through the second discharge port 64 is guided to the tape discharge port 16 (see FIGS. 2 and 3).

Figure 7B:
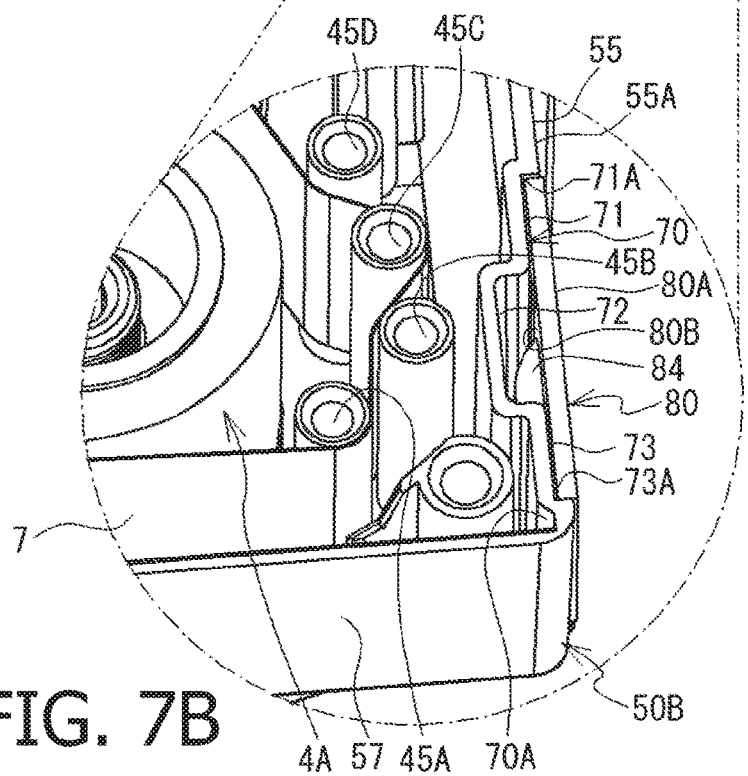
FIG. 7B is an enlarged perspective view of a circled portion of the laminate type tape cassette shown in FIG. 7A.

As shown in FIGS. 6, 7A and 7B, an arrangement part 70 and ribs 65A, 65B and 65C are provided to the right wall 55. The arrangement part 70 is located within the third area R3. On the arrangement part 70, a substrate 80 is arranged.

The ribs 65A, 65B and 65C are formed at positions on the rear side with respect to the substrate 80, and protrude outward from the cassette case 50, that is, ribs 65A, 65B and 65C are formed to protrude rightward from the right wall 55 to a right side with respect to the substrate 80. The rib 65A is formed to extend, at a central portion of the right wall 59 in the up-down direction, from the vicinity of a rear side of the arrangement part 70 to a rear side with respect to the central portion of the right wall 55 in the front-rear direction. The rib 65B is connected to a front end of the rib 65A, and extends in the up-down direction between the upper end and the lower end of the right wall 55. The rib 65C is connected to a rear end of the rib 65A, and extends in the up-down direction between the upper end and the lower end of the right wall 55.

As shown in FIG. 7A, ribs 66A, 66B and 66C are provided onto the left wall 56. The ribs 66A, 66B and 66C are formed at positions on the rear side with respect to the substrate 80, and protrude outward from the cassette case 50, that is, ribs 66A, 66B and 66C are formed to protrude leftward from the left wall 56 to a left side with respect to the substrate 80. The rib 66A extends in the right-left direction centering on a central position in the front-rear direction. The rib 66B is connected to a front end portion of the rib 66A and extends in the up-down direction between an upper end and a lower end of the left wall 56. The rib 66C is connected to a rear portion of the rib 66A and extends in the up-down direction between an upper and a lower end of the left wall 56.

As shown in FIG. 6, the cassette case 50 has common parts 50A, 50B and 50C and a pair of protrusions 511 and 512. The common part 50A is a right rear corner part of the cassette case 50, and includes a rear end portion of the right wall 55 and a right end portion of the rear wall 58. The common part 50B is a front right corner part of the cassette case 50, and includes a front end portion of the right wall 55 and the right end portion of the front wall 57. The common part 50C is a rear left part of the cassette case 50, and includes a rear end portion of the left wall 56 and the left end portion of the rear wall 58. A length, in the up-down direction, of each of the common parts 50A, 50B and 50C is smaller than a maximum length of the cassette case 50 in the up-down direction.

A protruding part 511 protrudes upward from the upper wall 53. A protruding part 512 protrudes downward from the lower wall 54. That is, the protruding parts 511 and 512 mutually protrude outward from the upper wall 53 and the lower wall 54, respectively. The protruding parts 511 and 512 respectively extend along peripheries of the upper wall 53 and the lower wall 54, respectively. An upper end part 501 of the protruding part 511 is located at an uppermost position of the cassette case 50. A lower end part 502 of the protruding part 512 is located at a lowermost position of the cassette case 50. Each of the common parts 50A, 50B and 50C are arranged between the upper end part 501 and the lower end part 502.

The protruding part 511 includes a first connection part 511A, a second connection part 511B and a third connection part 511C. the first connection part 511A is arranged in the vicinity of the common parts 50A. The first connection part 511A is configured such that one end is connected to the right wall 55, while the other end is connected to the rear wall 58. That is, the first connection part 511A connects the right wall 55 and the rear wall 58. The first connection part 511A has an arc shape having a center of curvature on a central side of the cassette case 50 with respect to the first connection part 511A.

The second connection part 511B is arranged in the vicinity of the common part 50B. The second connection part 511B is configured such that one end is connected to the right wall 55, while the other end is connected to the front wall 57. That is, the second connection part 511B connects the right wall 55 and the front wall 57. The second connection part 511B is curved from the vicinity of a front side of the rear end portion of the arrangement part 70 to an oblique left front side thereof. That is, the second connection part 511B has an arc shape having center of curvature on a central side of the cassette 50 with respect to the second connection part 511B (i.e., a position opposite to the substrate 80 and the common part 50B). It is noted that only a rear end part of the second connection part 511B (i.e., a connecting portion with the right wall 55) overlaps the arrangement part 70 and the substrate 80 in the up-down direction.

The third connection part 511C is arranged in the vicinity of the common part 50C. The third connection part 511C is configured such that one end is connected to the left wall 56, while the other end is connected to the rear wall 58. That is, the third connection part 511C connects the left wall 56 and the rear wall 58. The third connection part 511C has an arc shape having a center of radius on the central side of the cassette case 50 with respect to the third connection part 511C.

The protruding part 512 has a first connection part (not shown), a second connection part 512B and a third connection part (not shown). The first connection part, the second connection part 512B and the third connection part respectively correspond to the first connection part 511A, the second connection part 511B and the third connection part 511C of the protruding part 511. That is, the first connection part, the second connection part 512B and the third connection part of the protruding part 512 have substantially the same shapes, and only protruding directions are opposite to each other. Therefore, detailed description of the first connection part, the second connection part 512B and the third connection part of the protruding part 512 will be omitted for brevity.

Figure 8:
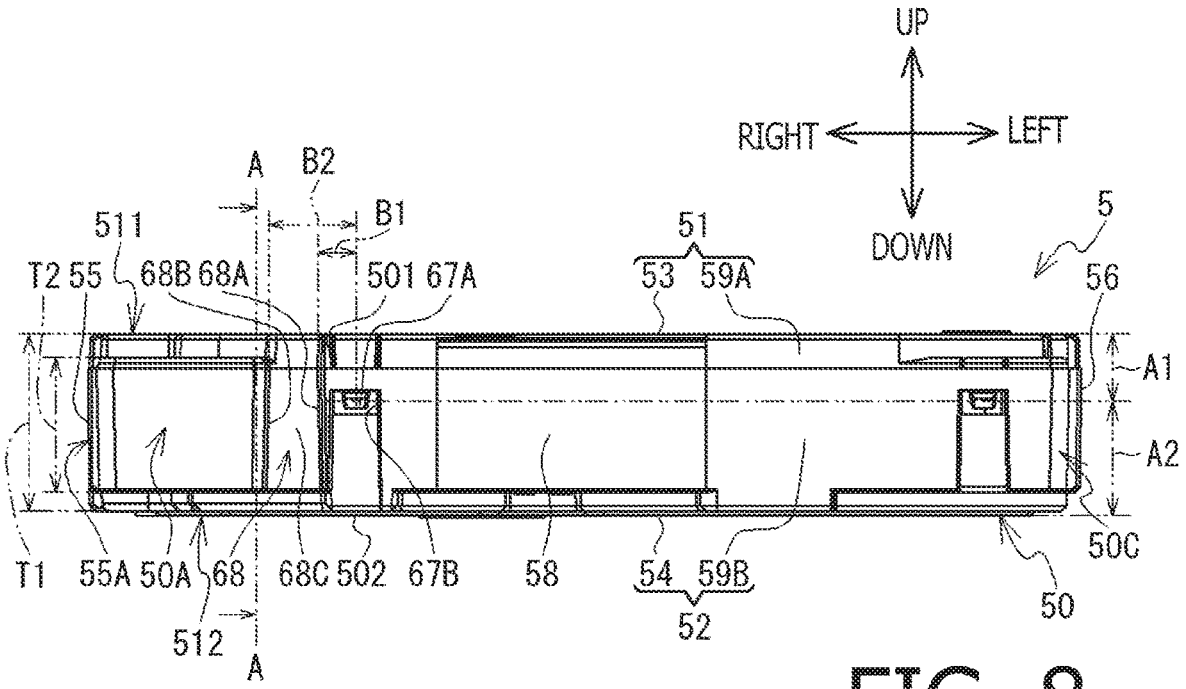
FIG. 8 is a rear view of the tape cassette.

As shown in FIG. 8, a hook 67A is provided on the rear wall 58 included in the upper case 51. The hook 67A extends downward from the rear wall included in the upper case 51 and is configured to be elastically deformable in the front-rear direction. On the rear wall 58 included in the lower case 52, a hole 67B is formed. The hole 67B is formed to penetrate through the rear wall 58 included in the lower case 52 in the front-rear direction. The hook 67A and the hole 67B area arranged at a substantially central portion, in the right-left direction, between the central wall 58 and the common part 50A of the rear wall 58. The hook 67A engages with the hole 67B from the front side in a state where the upper case 51 and the lower case 52 are coupled with each other. Further, in a state where the upper case 51 and the lower case 52 are coupled with each other, a distance A1, in the up-down direction, between the upper end part 501 and the hole 67B is smaller than a distance A2, in the up-down direction, between the lower end part 502 and the hole 67B.

As shown in FIGS. 7A and 8, a recess 68 is formed on the rear wall 58. The recess 68 is formed next to the hook 67A and the hole 67B. The recess 68 is recessed frontward from the rear wall 58, and extends in the up-down direction. The recess 68 has a first facing wall 68A, a second facing wall 68B and a connecting wall 68C.

The first facing wall 68A and the second facing wall 68B face each other in the right-left direction. The second facing wall 68B is arranged on the right side with respect to the first facing wall 68A. Therefore, a distance B2, in the right-left direction, between the second facing wall 68B and the hook 67A and the hole 67B is larger than a distance B1, in the right-left direction, between the first facing wall 68A and hook 67A or the hole 67B. The first facing wall 68A is connected to a portion which includes the upper end part 501 and the lower end part 502. That is, the first facing wall 68A is connected to a portion where the protruding parts 511 and 512, and the rear wall 58 are connected. Thus, a length T1, in the up-down direction, of the first facing wall 68A is larger than a length T2, in the up-down direction, of the second facing wall 68B. An upper end part of the first facing wall 68A is on an upper side with respect to the second facing wall 68B. A lower end part of the first facing wall 68A is on a lower side with respect to a lower end part of the second facing wall 68B. The connecting wall 68C extends in a direction perpendicular to the front-rear direction, and connects the front end part of the first facing wall 68A and the front end part of the second facing wall 68B.

As shown in FIG. 6 and FIG. 7A, the cassette case 50 has a tape driving roller 46 and supporting parts 49A-49D. The tape driving roller 46 has a cylindrical shape extending, in the up-down direction, between the upper wall 53 and the lower wall 54, and is arranged in a front left corner of the cassette case 50. The tape driving roller 46 is rotatably supported by the upper wall 53 and the lower wall 54. The supporting part 49A is a cylindrical member extending, in the up-down direction, between the upper wall 53 and the lower wall 54. The supporting parts 49B and 49C are shaft members extending, in the up-down direction, between the upper wall 53 and the lower wall 54. The supporting part 49D penetrates both the upper wall 53 and the lower wall 54 in the up-down direction.

As shown in FIG. 7A, the supporting part 49A is arranged on the oblique rear right side with respect to the tape driving roller 46, and rotatably supports a first tape spool 40. On the first tape spool 40, a first tape is wound. The supporting part 49B is arranged on the right side with respect to the supporting part 49A, and rotatably supports a second tape spool 41. On the second tape spool 41, a second tape is wound. The supporting part 49C is arranged on an oblique front right side with respect to the supporting part 49B, and rotatably supports a ribbon spool 42. On the ribbon spool 42, unused ink ribbon 4 is wound. The supporting part 49D is arranged on an oblique front right side with respect to the supporting part 49B, and rotatably supports a ribbon take-up spool 44 (see FIG. 6). The used ink ribbon 4 is taken up by the ribbon take-up spool 44, and wound thereon.

The tape cassette 5 could be of a laminate type, a receptor type, a thermal type, a tube type and the like by changing the type of the tape accommodated in the cassette case 50 and depending on presence/absence of the ink ribbon 4 in the cassette 5. FIG. 7A shows an example of the laminate type tape cassette 5. In the laminate type tape cassette 5, the supporting part 49A rotatably supports the first tape spool 40 on which a both-side adhesive tape 6 is wound as a first tape (hereinafter, referred to as a both-side adhesive tape roll 6A). The supporting part 49B rotatably supports the second tape spool 41 on which a film tape 7 is wound as a second tape (hereinafter, referred to as a film tape roll 7A). The supporting part 49C rotatably supports the ribbon spool 42 on which an unused ink ribbon 4 is wound (hereinafter, referred to as an ink ribbon roll 4A).

The both-side adhesive tape roll 6A, the film tape roll 7A and the ink ribbon roll 4A are supplying sources of the both-side adhesive tape 6, the film tape 7 and the ink ribbon 4, respectively. The both-side adhesive tape roll 6A, the film tape roll 7A and the ink ribbon roll 4A are accommodated inside the cassette case 50 such that the width direction of the both-side adhesive tape 6, the film tape 7 and the ink ribbon 4 coincides with the up-down direction of the cassette case 50. The recess 68 overlaps the ink ribbon roll 4 when viewed in the front-rear direction. A center Q of the ink ribbon roll 4A overlaps the recess 68 when viewed in the front-rear direction. The center Q coincides with a center of the supporting part 49C in a state where the ink ribbon roll 4A is supported by the supporting part 49C.

Figure 9:
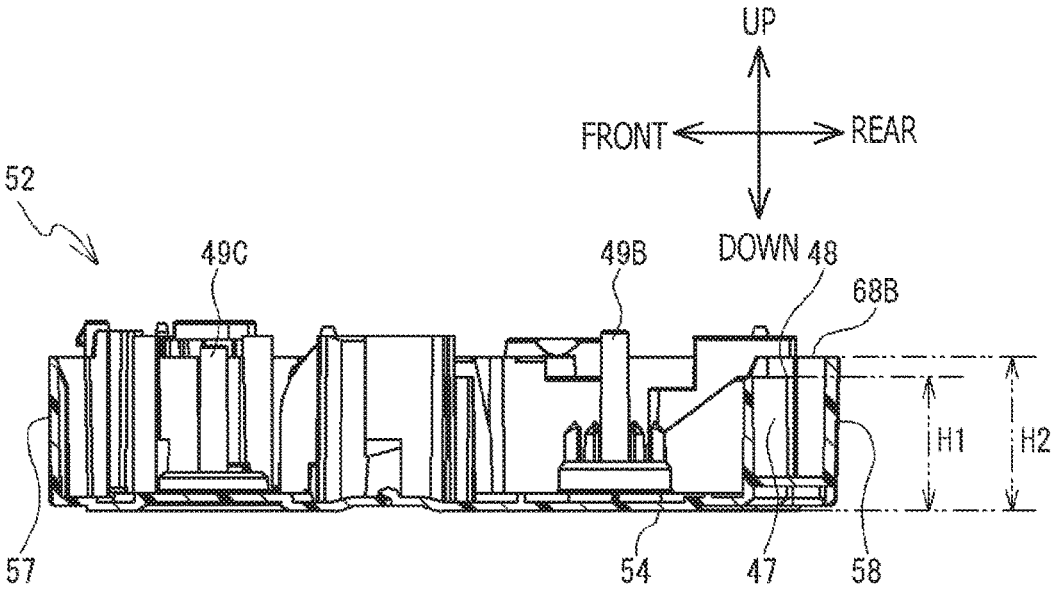
FIG. 9 is a cross-sectional view of the tape cassette taken along line A-A in FIG. 8 with the upper case removed.
Figure 10A:
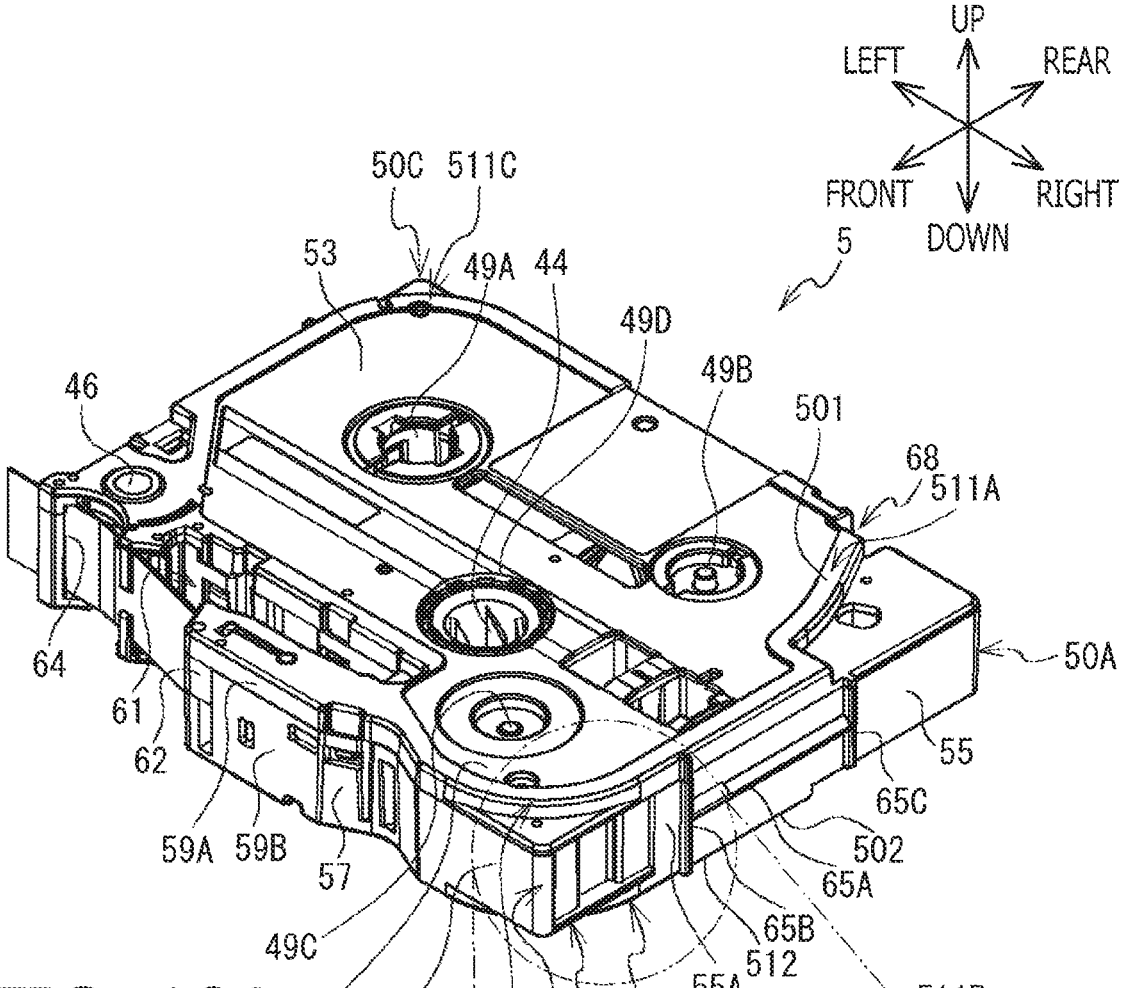
FIG. 10A is a perspective view of the tape cassette viewed from an upper right front side with a substrate being removed.
Figure 10B:
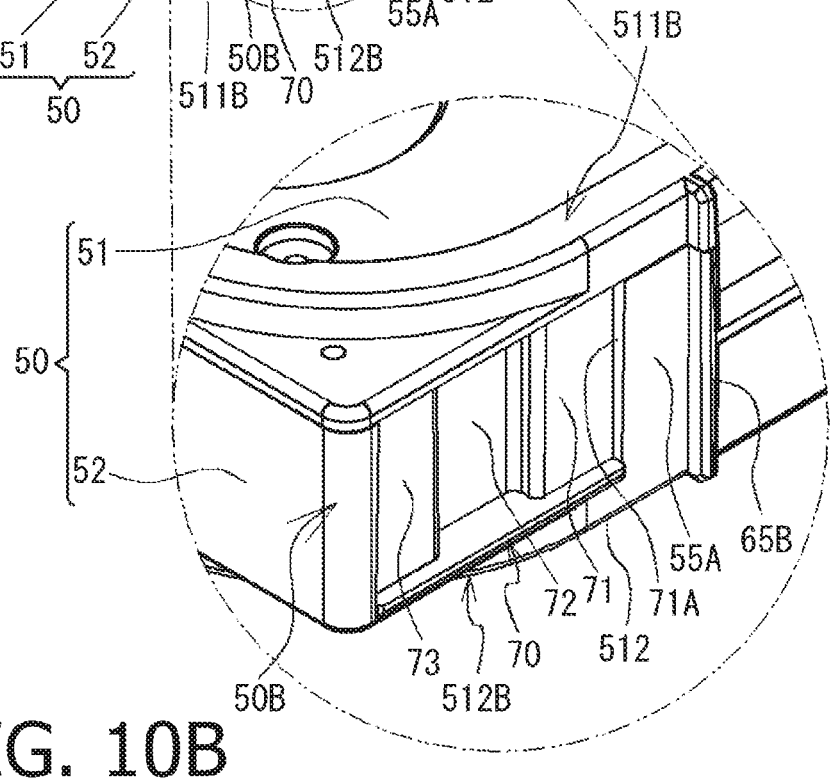
FIG. 10B is an enlarged perspective view of a circled portion of the tape cassette shown in FIG. 10A.

As shown in FIG. 7A and FIG. 9, a rib 47 is provided between the upper wall 53 and the lower wall 54 in the up-down direction. The rib 47 extends upward from the lower wall 54, has a circular shape centered around the supporting part 49B in a plan view, and is configured such that a front right part and a rear left part thereof are opened. On an inner side of the rib 47, the film tape roll 7A is arranged. The rib 47 surrounds a part, in a circumferential direction, of the film tape roll 7A. A rear end of the rib 47 is arranged in the vicinity of a front side of the rear wall 58. On the rear wall 58, a rib 48 is provided. The rib 48 protrudes frontward from the first facing wall 68A, and extends from the lower wall 54 to an upper end part of the rib 47. A front end part of the rib 48 is connected to the vicinity of a right side of the rear end part of the rib 47. The connecting wall 68C is arranged between, in the right-left direction, the second facing wall 68B and the rib 48. A height H1, in the up-down direction, of the rib 48 with respect to the lower wall 54 is smaller than a height H2, in the up-down direction, of the second facing wall 68B with respect to the lower wall 54 (see FIG. 9).

As shown in FIGS. 7A and 7B, on the right front side with respect to the ink ribbon roller 4A, curving pins 45A-45D are provided. The curving pins 45A, 45B, 45C and 45D are arranged from the front side to the rear side in this order. Each of the curving pins 45A, 45B, 45C and 45D has a cylindrical shape extending in the up-down direction, and is fixedly supported by the lower wall 54. The curving pins 45A, 45B, 45C and 45D define a conveying passage of the film tape 7. The conveying passage of the film tape 7 extends forward from the film tape roll 7A, turning to the left side via the curving pins 45D, 45C, 45B and 45A, and further extends to the second discharging port 64 via the first discharging port 63.

Next, referring to FIGS. 6, 7A, 7B, 10A, 10B, 11 and 12, the arrangement part 70 and the substrate 80 will be described. As shown in FIGS. 6, 7A, 7B, 10A and 10B, the arrangement part 70 is recessed leftward from the right wall 55. The arrangement part 70 is arranged at a position, on the right wall 55, next to the front wall 57, that is, at the common part 50B. The vicinity of the front end part of the arrangement part 70 overlaps the second discharge port 64 when viewed in the right-left direction.

As shown in FIGS. 7A and 7B, the front wall 57 and the arrangement part 70 are connected with each other at a connection part 70A. The connection part 70A is a right end part of the front wall 57, and is also a front end part of the right wall 55 (i.e., the arrangement part 70). The connection part 70A is shaped to bend, at a right end part of the front wall 57, to an oblique rear left direction to form an acute angle, and has an arc-like shape in plan view.

As shown in FIGS. 7A, 7B, 10A and 10B, the arrangement part 70 extends in the up-down direction between the vicinity of a lower side of the upper end part of the right wall 55 and the vicinity of an upper side of the lower end part of the right wall 55. That is, the arrangement part 70 does not extend to the upper wall 53 or the lower wall 54.

As shown in FIGS. 7A, 7B, 10A and 10B, the arrangement part 70 has a first wall 71, the relief recess 72 and a second wall 73. The first wall 71, the relief recess 72 and the second wall 73 are arranged in this order from the rear side to the front side, and form a bottom wall of the arrangement part 70. The first wall 71 and the second wall 73 are arranged on the left side with respect to the right surface of the right wall 55 (hereinafter, referred to as a particular surface 55A), and extends in parallel with the right wall 55. The relief recess 72 is formed on the third area R3, and recessed leftward from the first wall 71 and the second wall 73. Inside the cassette case 50, the bottom wall of the relief recess 72 faces, in the right-left direction, the tape in the conveying passage (e.g., the film tape 7 in FIGS. 7A and 7B).

Figure 11:
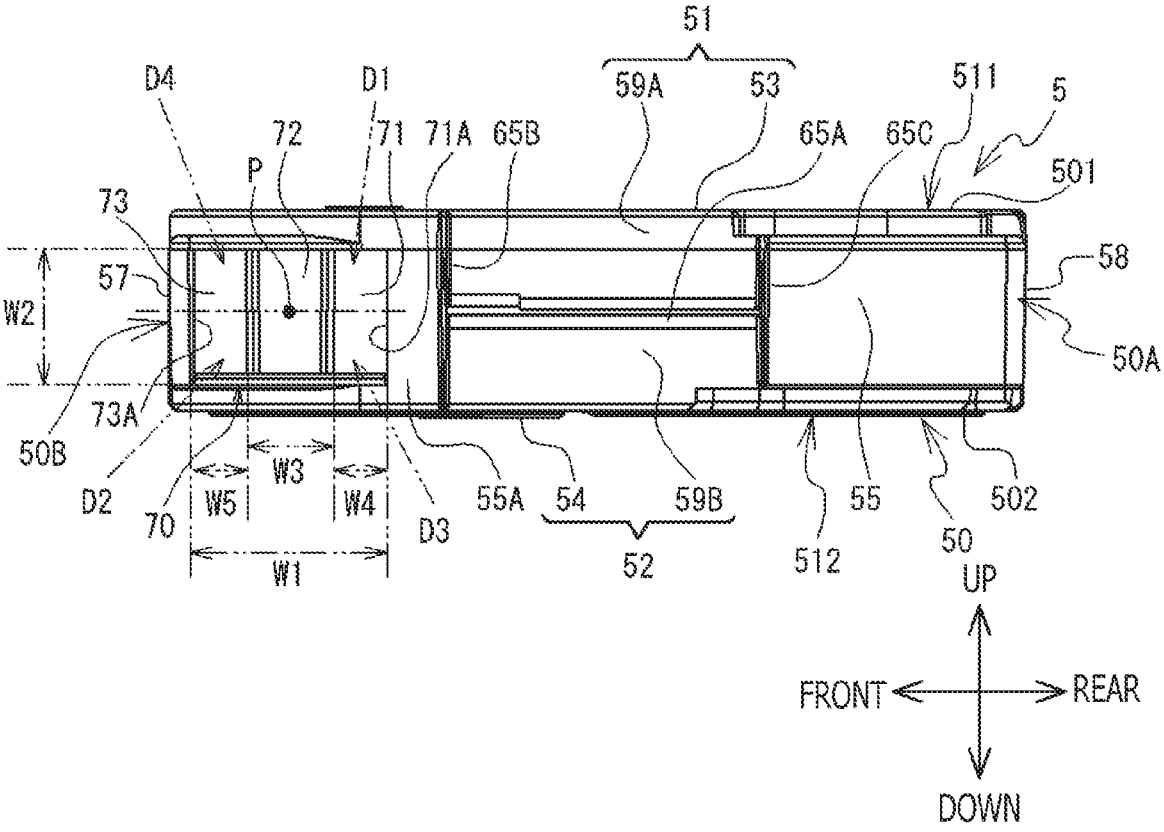
FIG. 11 is a right side view of the tape cassette.

In the following description, assuming that the first wall 71 and the second wall 73 are equally divided in the up-down direction, an upper area of the first wall 71, a lower are of the second wall 73, a lower area of the first wall 71 and an upper area of the second wall 73 will be referred to as a first arrangement area D1, a second arrangement area D2, a third arrangement area D3 and a fourth arrangement area D4, respectively, as shown in FIG. 11.

A surface of each of the first arrangement area D1, the second arrangement area D2, the third arrangement area D3 and the fourth arrangement area D4 is a planar surface. It is noted that, in the description, the planar surface is defined as not only a completely planar surface but a surface which does not form a curved surface and does not have a convex part. Thus, according to the above definition, the planar surface may include a surface formed with a concave part.

In the following description, a center of an area composed by the first wall 71, the relief recess 72 and the second wall 73 in side view (i.e., an area which is formed when the arrangement part 70 is projected in the right-left direction) will be referred to as a "center P." The center P coincides with an intersecting point of diagonal lines of a rectangle defined by a lower rear corner of the first wall 71, an upper rear corner of the first wall 71, a lower front corner of the second wall 73 and an upper front corner of the second wall 73 in side view. A surface shape of the first arrangement area D1 and a surface shape of the second arrangement area D2 are symmetrical with respect to the center P. Similarly, a surface shape of the third arrangement area D3 and a surface shape of the fourth arrangement area D4 are symmetrical with respect to the center P.

As shown in FIG. 6, the substrate 80 has a rectangular shape having longer sides and shorter sides. Further, the substrate 80 has a first surface 80A and a second surface 80B (see FIG. 12). The first surface 80 and the second surface 80 face opposite sides. On the first surface 80A, a pair of (i.e., two) cassette side conductive electrodes 81 are provided. Each of the two cassette side conductive electrodes 81 is a metallic electrode. The two cassette side conductive electrodes 81 are arranged in a longer side direction (hereinafter, referred to as a Y1 direction: see FIG. 12) of the substrate 80 with a particular clearance therebetween. Each of the two cassette side conductive electrodes 81 has a rectangular shape elongated in a shorter side direction (hereinafter, referred to as a Y2 direction: see FIG. 12) of the substrate 80. The two cassette side conductive electrodes 81 have the same shapes. One side ends, in the Y2 direction (e.g., the upper side in FIG. 12), of the two cassette side conductive electrodes 81 are located at the same positions in the Y2 direction. Further, the other side ends, in the Y2 direction (e.g., the lower side in FIG. 12), of the two cassette side conductive electrodes 81 are located at the same positions in the Y2 direction.

A length, in the longer side direction (i.e., Y2 direction), of the pair of cassette side conductive electrodes 81 is shorter than a length, in the longer side direction (i.e., the up-down direction in FIG. 2) of the pair of main body side conductive electrodes 34 (see FIG. 2). Further, a length, in the shorter side direction (i.e., Y1 direction), of the pair of cassette side conductive electrodes 81 is longer than a length, in the shorter side direction (i.e., the right-left direction in FIG. 2) of the pair of main body side conductive electrodes 34 (see FIG. 2). Furthermore, a distance between the two cassette side conductive electrodes 81 is shorter than a distance between the two main body side conductive electrodes 34.

Figure 12:
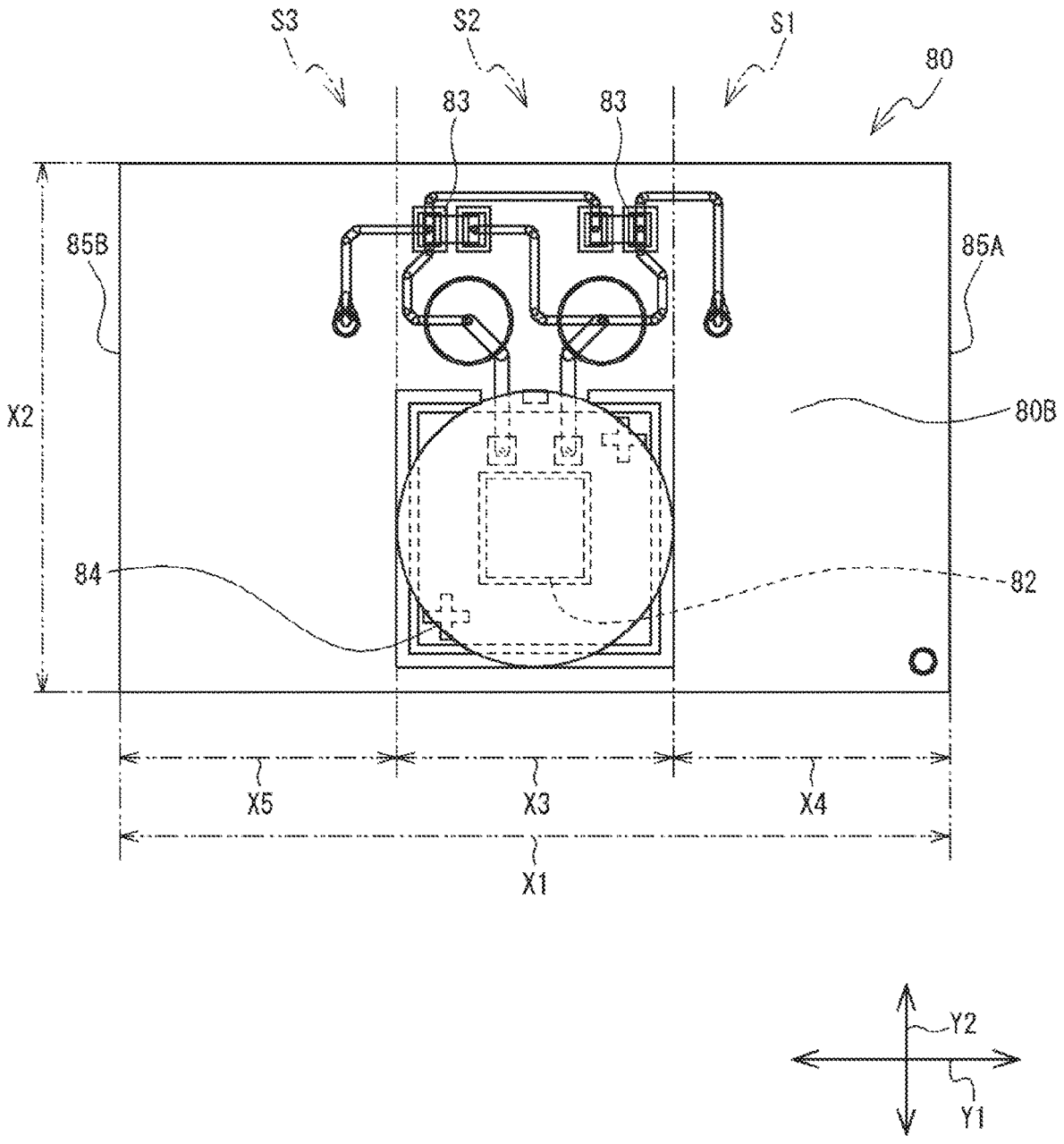
FIG. 12 shows the substrate viewed from a second surface side thereof.

As shown in FIG. 12, an IC chip 82, two condensers 83 and a molded part 84 are provided on the second surface 80B. The IC chip 82 is electrically connected to the two cassette side conductive electrodes 81 via the two condensers 83, respectively. The IC chip 82 is configured to store various pieces of information such as information of the type of the tape cassette 5 (e.g., the laminate type), information of the type of the tape (e.g., the color, the width) and the like. The two condensers 83 are connected to pass electric signals having a particular frequency. The molded part 84 is a resin member covering the IC chip 82 to protect the same.

In the following description, a right-hand side of FIG. 12 will be referred to as a "one-way side" in the Y1 direction, and a left-hand side of FIG. 12 will be referred to as the "other-way side" in the Y1 direction. Further, the second surface 80B is equally divided into three areas in the Y1 direction and the three divided areas will be referred to as "a first substrate area S1," "a second substrate area S2" and "a third substrate area S3" in this order from one side (i.e., the right-hand side in FIG. 12) to the other side (i.e., the left-hand side in FIG. 12) in the Y1 direction. As shown in FIG. 12, the IC chip 82, the condensers 83 and the molded part 84 are all arranged within the second substrate area S2.

As shown in FIGS. 11 and 12, a distance W1 (i.e., the length of the arrangement part 70 in the front-rear direction), in the front-rear direction, between a rear end part 71A of the first wall 71 and a front end part 73A of the second wall 73 is slightly larger than a length X1, in the Y1 direction, of the substrate 80. A length W2, in the up-down direction, of the first wall 71 and the second wall 73 is slightly larger than a length X2, in the Y2 direction, of the substrate 80. A length W3, in the front-rear direction, of the relief recess 72 is larger than a length X3, in the Y1 direction, of the molded part 84.

Hereinafter, an end part of the substrate 80 on the one side in the Y1 direction (i.e., the right-hand side in FIG. 12) will be referred to as a "first substrate end part" 85A, and an end part of the substrate 80 on the other side in the Y1 direction (i.e., the left-hand side in FIG. 12) will be referred to as a "second substrate end part" 85B. It is noted that a length W4 of the first wall 71 in the front-rear direction and a length W5 of the second wall 73 in the front-rear direction are shorter than a distance X4, in the Y1 direction, between the molded part 84 (specifically, one end of the molded part 84 in the Y1 direction) and the first substrate end part 85A, and a distance X5, in the Y1 direction, between the molded part 84 (specifically, the other end of the molded part 84 in the Y1 direction) and the second substrate end part 85B, respectively.

In other words, the length W4, in the front-rear direction, of the first wall 74 is smaller than the distance X4 or X5, in the Y1 direction, between one of the IC chip 82 and the molded part 84, and each end, in the Y1 direction, of the substrate 80, and the length W5, in the front-rear direction, of the second wall 73 is smaller than the distance X4 or X5, in the Y1 direction, between one of the IC chip 82 and the molded part 84, and each end, in the Y1 direction, of the substrate 80.

As shown in FIGS. 7A and 7B, the substrate 80 is arranged at the arrangement part 70 with the Y1 direction (see FIG. 12) being parallel to the front-rear direction of the tape cassette 5, and the first surface 80A facing rightward. It is noted that the substrate 80 can be arranged at the arrangement part 70 with the one side part in the Y1 direction (i.e., the right-hand side part in FIG. 12) being directed either rearward or frontward of the tape cassette 5. Between each of the first wall 71 and the second wall 73, and the second surface 80B, an adhesion layer (not shown) is provided. The adhesive layer is formed by, for example, an adhesive, a both-side adhesive tape, or the like. The substrate 80 is arranged to be bridged between the first wall 71 and the second wall 73 with the adhesive layer being sandwiched therebetween.

Next, a state where the substrate 80 is arranged at the arrangement part 70 will be described. The molded part 84 and the IC chip 82 are arranged at the relief recess 72. The particular surface 55A and the first surface 80A are arranged at the same positions in the right-left direction. The substrate 80 is arranged in the third area R3. A center of the substrate 80 in the font-rear direction is located on the front side with respect to a center of the second discharge port 64 in the front-rear direction. A part of the substrate 80 overlaps the second discharge port 64 in the right-left direction. Specifically, a front side one of the two cassette side conductive electrodes 81 overlaps the second discharge port 64 in the right-left direction.

Figure 13:
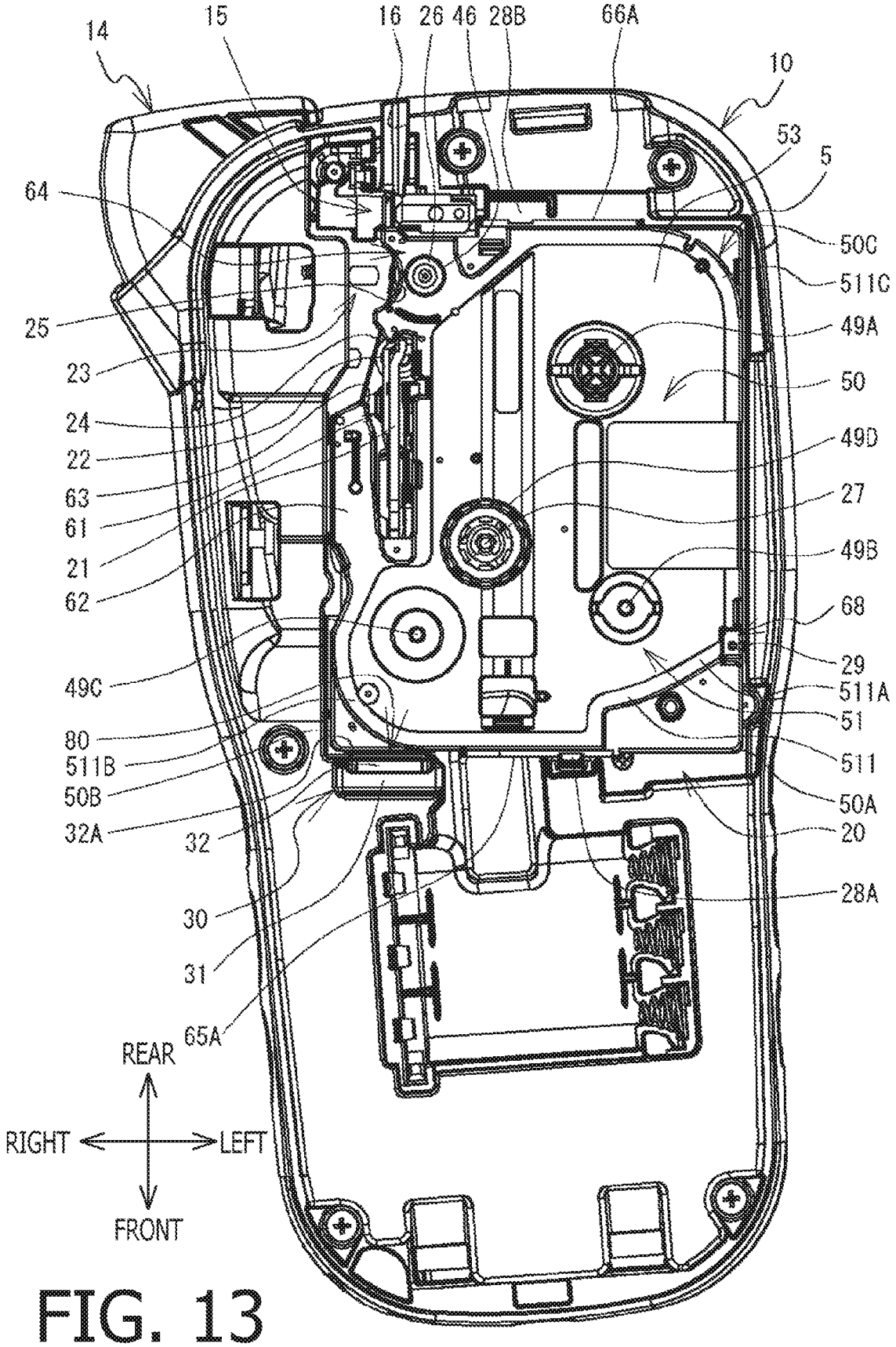
FIG. 13 is a bottom plan view of the casing when the tape cassette is attached to a cassette attachment part.

Referring to FIG. 13, how the tape cassette 5 is attached to the cassette attachment part 20, and the printing operation performed by the printer 1 will be described. A user of the printer 1 attaches the tape cassette 5 to the cassette attachment part 20 such that the substrate 80 faces the electrode unit 30. During a process where the tape cassette 5 is attached to the cassette attachment part 20, the second connection part 512B contacts the rear left portion of the upper end part of the electrode holder 32 from below. Since the rear portion of the upper end part of the electrode holder 32 is inclined in an oblique rear upward direction, the electrode holder 32 is urged frontward by the second connection part 512B. Then, the electrode holder 32 moves from the first position (see FIG. 4) to the second position (see FIG. 5) against the urging force by the urging member 33.

The thermal head 22 is inserted in the head insertion part 61. The tape driving shaft 26 is inserted in the tape driving roller 46. The ribbon take-up shaft 27 is inserted in the ribbon take-up spool 44. The rib 29 is inserted in the recess 68. It is noted that a tape cassette which is not formed with the recess 68 cannot be attached to the cassette attachment part 20 since such a tape cassette interferes with the rib 29. Thus, by the recess 68 and the rib 29, a tape cassette which is different from the tape cassette 5 is prevented from being attached to the cassette attachment part 20. The hooks 28A and 28B engages with the ribs 65A and 66A, respectively. According to the above configuration, the position of the tape cassette 5 with respect to the cassette attachment part 20 is fixed, thereby attachment of the tape cassette 5 to the cassette attachment part 20 being completed.

In a state where the tape cassette 5 is attached to the cassette attachment part 20, the two cassette side conductive electrodes 81 and the two main body side conductive electrodes 34 face in the front-rear direction, and contact so as to be electrically connected, respectively. A length of the pair of cassette side conductive electrodes 81 in the longer side direction (i.e., in the Y2 direction) is shorter than a length of the pair of main body side conductive electrodes 34 in the longer side direction (i.e., in the up-down direction in FIG. 2). A length of the pair of cassette side conductive electrodes 81 in the shorter side direction (i.e., in the Y1 direction) is larger than a length of the pair of main body side conductive electrodes 34 in the shorter side direction (i.e., in the right-left direction in FIG. 2). A distance between the two cassette side conductive electrodes 81 is shorter than a distance between the two main body side conductive electrodes 34.

In a state where the two cassette side conductive electrodes 81 and the two main body side conductive electrodes 34 face in the front-rear direction, and contact so as to be electrically connected, respectively, the printer 1 is in a state to be communicatable with the tape cassette 5. Specifically, the printer 1 can receive a signal from the IC chip 82 in accordance with a generally-known modulation method using respective voltage differences at contacts between the pair of main body side conductive electrodes 34 and the pair of cassette side conductive electrodes 81.

When the cover 19 (see FIG. 1) is closed with respect to the casing 10, the platen holder 23 rotates leftward. The platen roller 24 sandwiches, in association with the thermal head 22, the film tape 7 and the ink ribbon 4 where are overlaid each other. The tape sub roller 25 sandwiches, in association with the tape driving roller 46, the both-side adhesive tape 6 and the film tape 7.

When the printer 1 starts the printing operation, the tape driving shaft 26 and the ribbon take-up shaft 27 are driven to rotate by a motor (not shown) synchronously. In association with rotation of the tape driving shaft 26, the tape driving roller 46 rotates, and the tape sub roller 25 follows to rotate. When the tape driving roller 46 and the tape sub roller 25 rotate, the both-side adhesive tape 6 and the film tape 7 are drawn out from the both-side adhesive tape roll 6 and the film tape roller 7A and conveyed, respectively. In association with rotation of the ribbon take-up shaft 27, the ribbon take-up spool 44 rotates. When the ribbon take-up spool 44 rotates, the ink ribbon 4 is drawn out from the ink ribbon roll 4A. The ink ribbon 4 is overlaid on the film tale 7 between the platen roller 24 and the thermal head 22 is used, thereby printing by the thermal head on the film tape 7 being performed. Between the tape sub roller 25 and the tape driving roller 46, the both-side adhesive tape 6 is adhered on the film tape on which the printing operation has been performed, and discharged to outside from the second discharge port 64.

As described above, according to the illustrative embodiment, since the two cassette side conductive electrodes 81 area arranged in the Y1 direction, even if the substrate 80 is arranged to be bridged between the first wall 71 and the second wall 72 with its orientation, in the Y1 direction, with respect to the front-rear direction of the tape cassette 5 being reversed, a positional relationship between the two cassette side conducive electrodes 81 remain unchanged.

Since the IC chip 82 and the molded part 84 are arranged at the relief recess 72, even if the substrate 80 is arranged to be bridged between the first wall 71 and the second wall 73 with its orientation, in the Y1 direction, with respect to the front-rear direction of the tape cassette 5 being reversed, a positional relationship of the storage with respect to the cassette case 50 remains unchanged.

Further, since the IC chip 82 is arranged in the second substrate area S2, and the second substrate area S2 includes the central part, in the Y1 direction, of the second surface 80B, even if the substrate 80 is arranged to be bridged between the first wall 71 and the second wall 73 with its orientation, in the Y1 direction, with respect to the front-rear direction of the tape cassette 5 being reversed, a positional relationship of the pair of cassette side conductive electrodes 81 with respect to the cassette case 50 may hardly change.

Therefore, a worker can attach the substrate 80 so as to be bridged between the first wall 71 and the second wall 73 even if the orientation of the substrate 80 in the Y1 direction with respect to the tape cassette 5 being reversed. Accordingly, it becomes unnecessary for the worker to consider the orientation of the substrate 80 in the Y1 direction with respect to the front-rear direction of the tape cassette 5 when attaching the substrate 80 to the cassette case 50. According to the tape cassette 5 described above, workability of the worker in attaching the substrate 80 to the cassette case 50 can be improved.

According to the illustrative embodiment, the surface shape of the first arrangement area D1 and the surface shape of the second arrangement area D2 are symmetrical with respect to the center P. Further, the surface shape of the third arrangement area D3 and the surface shape of the fourth arrangement area D4 are symmetrical with respect to the center P. Therefore, even if the substrate 80 is arranged to be bridged between the first wall 71 and the second wall 72 with its orientation, in the Y1 direction, with respect to the front-rear direction of the tape cassette 5 being reversed, a positional relationship of the pair of cassette side conductive electrodes 81 with respect to the cassette case 50 may hardly change.

According to the illustrative embodiment, the distance W1 is slightly longer than the length X1. The length W3 is longer than the length X3. Each of the lengths W4 and W5 is shorter than each of the distances X4 and X5. Therefore, even if the orientation of the substrate 80 in the Y1 direction is reversed with respect to the front-rear direction of the tape cassette 5, the second surface 80B is arranged to be bridged between the first wall 71 and the second wall 73 with the IC chip 82, the condensers 83 and the molded part 84 being arranged in the relief recess 72. Therefore, according to the tape cassette 5, it is ensured that, even if the orientation of the substrate 80 in the Y1 direction is reversed with respect to the front-rear direction of the tape cassette 5, the substrate 80 can be attached with being bridged between the first wall 71 and the second wall 73.

According to the illustrative embodiment, the surface shapes of the first arrangement area D1, the second arrangement area D2, the third arrangement area D3 and the fourth arrangement area D4 are planar surfaces. Therefore, it is suppressed that a clearance, in the right-left direction, is formed between the second surface 80B and the first/second walls 71 and 73 when the substrate 80 is arranged to be bridged between the first wall 71 and the second wall 73. Therefore, the worker can attach the substrate 80 to the arrangement part 70 easily and securely.

According to the illustrative embodiment, since the condensers 83 are arranged in the second substrate area S2, ever if the orientation of the substrate 80 in the Y1 direction is reversed with respect to the front-rear direction of the tape cassette 5, the worker can attach the substrate 80 with being bridged between the first wall 71 and the second wall 73.

When the tape is pushed toward an inside of the cassette case 50 (i.e., toward an upstream side in the tape conveying direction), loosening of the tape occurs. When the loosening of the tape occurs, a malfunction in conveying the tape may occur easily. According to the cassette case 50 described above, the bottom wall of the relief recess 72 faces the tape on the conveying passage in the right-left direction, and the loosened tape contacts the relief recess 72. Therefore, in comparison with a case where the bottom wall of the relief recess 72 does not face the tape on the conveying passage, the tape cassette 5 according to the illustrative embodiment can suppress the loosening of the tape which is caused as the tape is pushed toward the inside of the cassette case 50.

According to the illustrative embodiment, since the second discharge port 64 and the relief recess 72 are arranged in the third area R3, when the tape located at the second discharge port 64 is pushed toward the inside of the cassette case 50, the loosened tape tends to contact the relief recess 72. Therefore, in comparison with a case where the bottom wall of the relief recess 72 does not face the tape on the conveying passage, the tape cassette 5 according to the illustrative embodiment can suppress the loosening of the tape which is caused as the tape is pushed toward the inside of the cassette case 50.

According to the illustrative embodiment, since the first/second walls 71 and 73 are arranged on the left side with respect to the particular surface 55A, in comparison with a case where both the first/second walls 71 and 73 are not arranged on the left side with respect to the particular surface 55A, a portion of the substrate 80 protruding rightward from the particular surface 55A can be downsized. Therefore, when the tape cassette 5 is placed on a mounting surface (e.g., on an upper surface of a work table) with the substrate 80 being faced thereto, the substrate 80 and the pair of cassette side conductive electrodes 81 may hardly receive stress due to contact with the mounting surface. Therefore, according to the tape cassette 5, a bad influence which is cause as the stress acts on the substrate 80 and the pair of cassette side conductive electrodes 81 can be suppressed. Since a portion of the substrate 80 protruding rightward from the particular surface 55A is downsized, it is possible to prevent the substrate 80 from coming off the arrangement part 70 as the portion of the substrate 80 protruding rightward from the particular surface 55A is caught when the cassette 5 is being used.

According to the illustrative embodiment, since the particular surface 55A and the first surface 80A are arranged at the same position in the right-left direction, when the tape cassette 5 is placed on a mounting surface (e.g., on an upper surface of a work table) with the substrate 80 being faced thereto, the substrate 80 and the pair of cassette side conductive electrodes 81 may hardly receive stress due to contact with the mounting surface. Therefore, according to the tape cassette 5, a bad influence which is cause as the stress acts on the substrate 80 and the pair of cassette side conductive electrodes 81 can be suppressed. When a portion of the substrate 80 does not protrude rightward from the particular surface 55A, it is possible to prevent the substrate 80 from coming off the arrangement part 70 as the portion of the substrate 80 protruding rightward from the particular surface 55A is caught when the cassette 5 is being used.

It is noted that the upper wall 53 is an example of a first outer wall according to aspects of the present disclosures. The lower wall 54 is an example of a second outer wall according to aspects of the present disclosures. The right wall 55 is an example of a third outer wall according to aspects of the present disclosures. The left wall 56 is an example of a fourth outer wall according to aspects of the present disclosures. The front wall 57 is an example of a fifth outer wall according to aspects of the present disclosures. The rear wall 58 is an example of a sixth outer wall according to aspects of the present disclosures. The up-down direction of the tape cassette 5 is an example of a first direction according to aspects of the present disclosures. The right-left direction of the tape cassette 5 is an example of a second direction according to aspects of the present disclosures. The front-rear direction of the tape cassette 5 is an example of a third direction according to aspects of the present disclosures. The pair of cassette side conductive electrodes 81 is an example of a pair of conductive electrodes according to aspects of the present disclosures.

The IC chip 82 is an example of a storage according to aspects of the present disclosures. The first wall 71 is an example of a first side wall according to aspects of the present disclosures. The left side direction is an example of a fourth direction according to aspects of the present disclosures. The relief recess 72 is an example of a concave part according to aspects of the present disclosures. The second wall 73 is an example of a second side wall according to aspects of the present disclosures. The front side direction of the tape cassette 5 is an example of a fifth direction according to aspects of the present disclosures. The Y1 direction of the substrate 80 is an example of a sixth direction according to aspects of the present disclosures. The right side direction of the tape cassette 5 is an example of a seventh direction according to aspects of the present disclosures. The upper side direction of the tape cassette 5 is an example of an eighth direction according to aspects of the present disclosures. The downside direction of the tape cassette 5 is an example of a ninth direction according to aspects of the present disclosures. It is noted that each of the eighth direction and the ninth direction is a one-way direction. The second discharge port 64 is an example of a discharging part according to aspects of the present disclosures. The supporting part 49B is an example of a supporting part according to aspects of the present disclosures.

Figure 14:
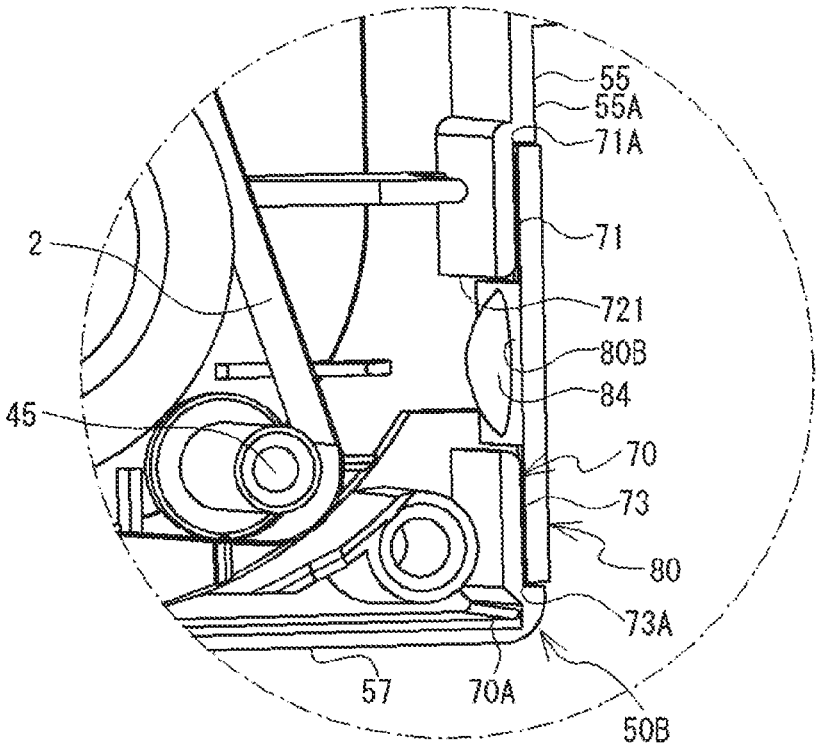
FIG. 14 is an enlarged partial perspective view, viewed from a substantially upper side, of an arrangement part at which a relief hole is formed instead of a relief recess according to a modified embodiment.

According to aspects of the present disclosures, the above-described illustrative embodiment can be modified in various ways. For example, the IC chip 82 is protected by the molded part 84 in the above-described embodiment. The configuration may be modified such that the molded part 84 may be omitted. As shown in FIG. 14, the tape cassette 5 may employ a relief hole 721 instead of the relief recess 72. The relief hole 721 is formed to penetrate through the bottom wall of the arrangement part 70 in the right-left direction. In a state where the substrate 80 is arranged in the arrangement part 70, the molded part 84 is arranged in the relief hole 721. The molded part 84 faces, in the right-left direction, the tape located in the conveying passage (e.g., the film tape 7 in FIG. 14) inside the cassette case 50. When the molded part 84 is omitted, in a state where the substrate 80 is arranged in the arrangement part 70, the IC chip 82 is arranged in the relief hole 721. The IC chip 82 faces the tape located on the conveying passage in the right-left direction inside the cassette case 50.

According to the illustrative embodiment, the cassette 5 is of the laminate type, which may be the receptor type, the thermal type, the tubular type or the like instead. The receptor type tape cassette may be configured such that the second tape spool 41 is omitted from the above-described configuration, and the support part 49A may support the first tape spool 40 on which one-sided adhesive tape is wound as the first tape. The thermal type tape cassette 5 may be configured such that the ink ribbon roll 4A is omitted, and the supporting part 49A may support the first tape spool 40 on which a thermos-sensitive tape may be wound as the first tape.

Figure 15A:
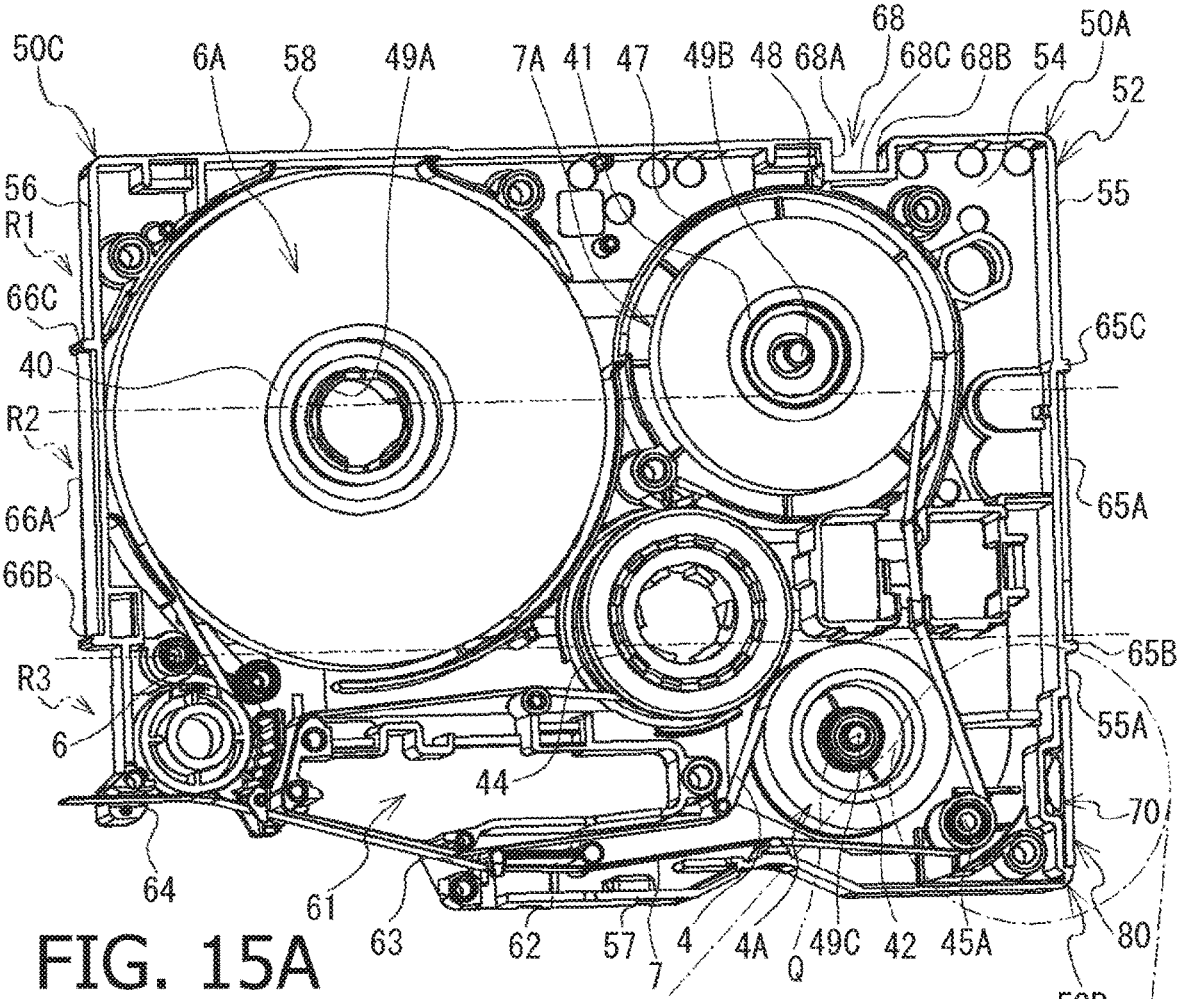
FIG. 15A is a perspective view, viewed from a substantially upper side, of a tape cassette according to the modified embodiment.
Figure 15B:
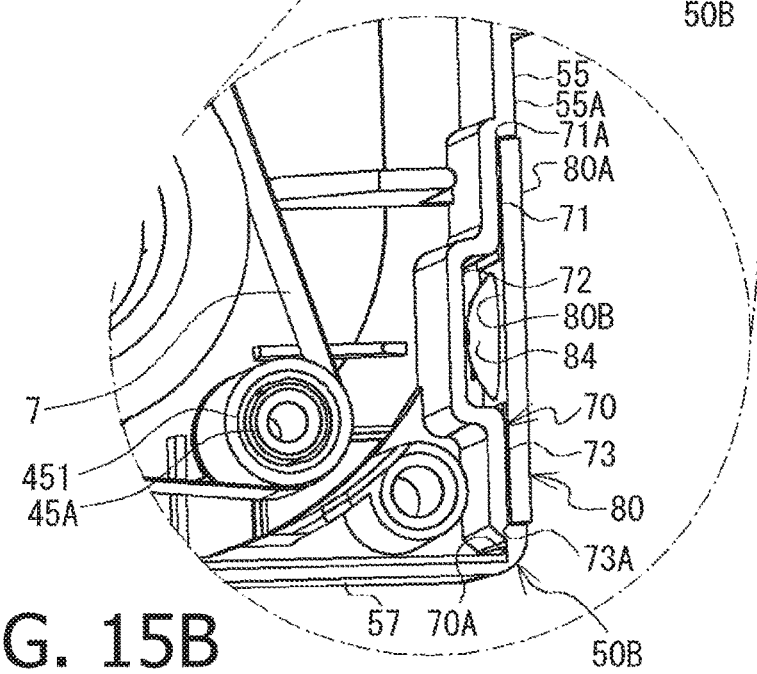
FIG. 15B is an enlarged perspective view, viewed from a substantially upper side, of the circled portion of the tape cassette shown in FIG. 15A.

Next, referring to FIGS. 15A and 15B, a modified tape cassette 5 will be described. In the following description, configurations same as those of the above-described embodiment will be assigned with the same reference numbers and description thereof will be simplified/omitted, while configurations different from those of the above-described embodiment will be mainly described.

According to the modified embodiment, the widths of the both-side adhesive tape 6 and the film tape 7 are smaller than those according to the above-described illustrative embodiment. In order that the tape cassette 5 applies an appropriate conveying load to the film tape 7, the number of curving pins are different depending on the tape width. According to the tape cassette 5 of the modified embodiment, the curving pins 45B-45D are omitted. That is, on the right front side of the ink ribbon roll 4A, only the curving pin 45A is provided. The curving pin 45A rotatably supports a cylindrical member 451. The conveying passage of the film tape 7 extends frontward from the film tape roll 7A, and curves leftward along a right end portion of an outer periphery of the cylindrical member 451. When the film tape 7 is conveyed, the cylindrical member 451 is driven to rotate, thereby the conveying load to the film tale being suppressed. It is noted that the number of curving pins may be fixed depending on the tape width. Inside the cassette case 50, the bottom wall of the relief recess 72 faces the tape on the conveying passage (e.g., the film tape 7 in the example shown in FIG. 7A) in the right-left direction.

Figure 16:
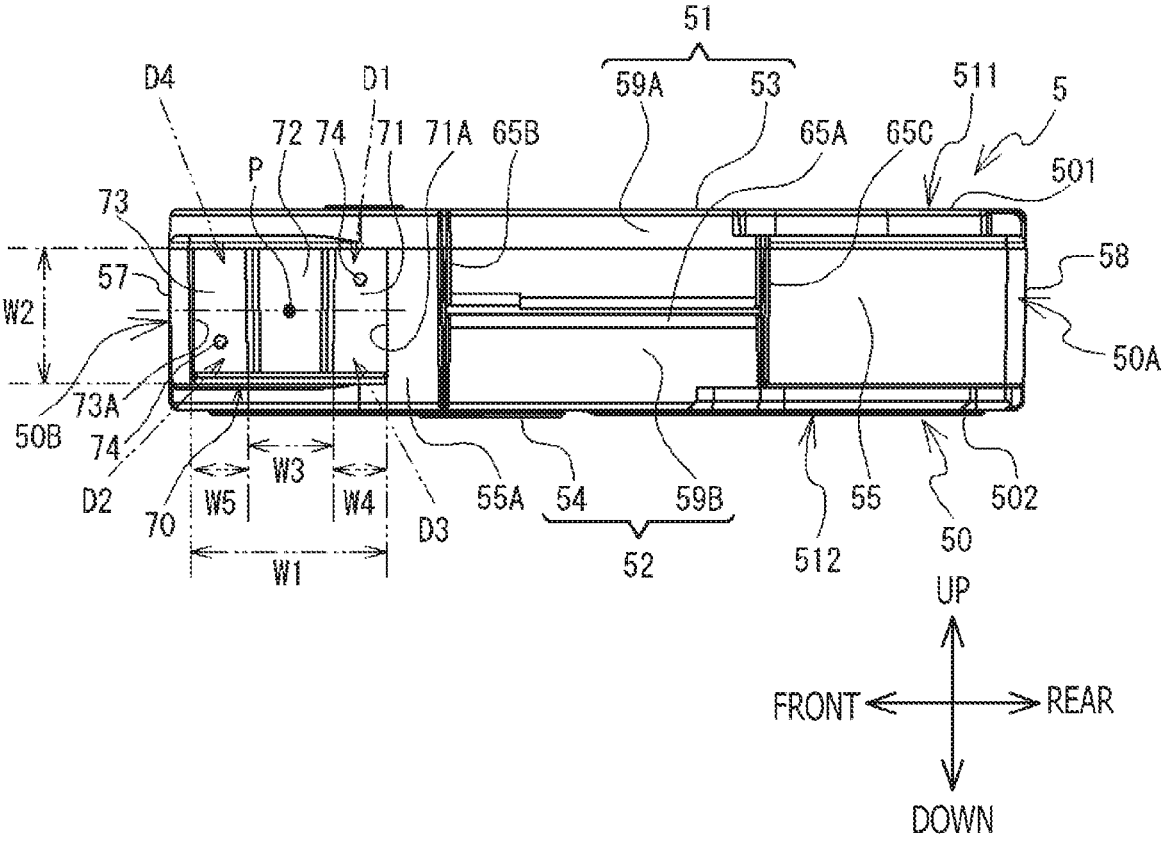
FIG. 16 is a right side view of a tape cassette according to a modified embodiment having a pair of protrusions, with the substrate being removed.
Figure 17:
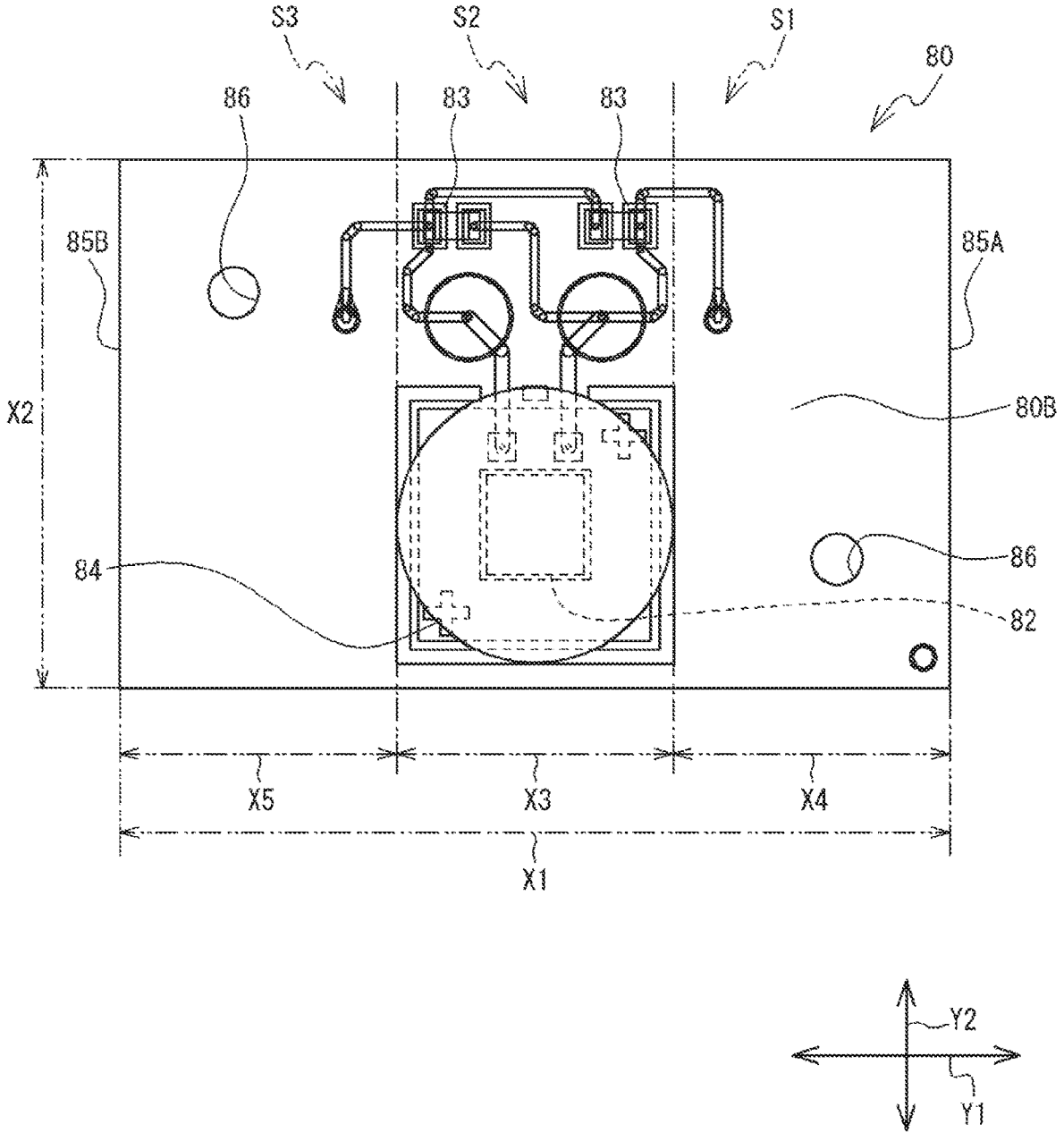
FIG. 17 shows a substrate having a pair of holes viewed from a second surface thereof.

Next, referring to FIGS. 16 and 17, the arrangement part 70 and the substrate 80 according to the modified embodiment will be described. As shown in FIG. 16, on the first wall 71 and the second wall 73, a pair of protrusions 74 are formed, respectively. Further, as shown in FIG. 17, on the second surface 80B, a pair of holes 86 may be provided. The pair of protrusions 74 protrude rightward from positions which are symmetrical with respect to the center P. The pair of protrusions have cylindrical shapes, respectively, and are symmetrical with respect to the center P. It is noted, however, the shape of the pair of protrusions 74 need not be limited to the cylindrical shape, and can be another shape such as a square prism shape. The pair of holes 86 are recessed rightward at positions which are symmetrical with respect to the center of the substrate 80 and respectively correspond to the pair of protrusions 74. Each of the pair of holes 86 has a circular shape, and the two holes 86 are symmetrical with respect to the center of the substrate 80. It is noted that the shape of the pair of holes 86 need not be limited to the circular shape, and could be any shape which correspond to the shape of the pair of protrusions 74. The pair of holes 86 may be formed to penetrate through the substrate in the right-left direction. A diameter of the pair of protrusions 74 is slightly smaller than a diameter of the pair of holes 86.

When the substrate 80 is arranged at the arrangement part 70, the pair of protrusions 74 are fitted in the pair of holes 86, respectively. Thus, the substrate 80 can be attached to the arrangement part 70 securely. Since the pair of protrusions 74 are arranged at positions symmetrical with respect to the center P, even if the orientation, in the Y1 direction, of the substrate 80 is reversed in the front-rear direction, the substrate 80 can be arranged at the arrangement part 70. It is noted that a plurality of pairs of protrusions 74 may be provided to the first wall 71 and the second wall 73. Further, on the second surface 80B, a plurality of pairs of holes 86 may be formed on the second surface 80B. Alternatively, a pair of holes are formed on the first wall 71 and the second wall 73, while a pair of protrusions 74 may be formed on the second surface 80B.

According to the above-described embodiment, the front side one of the pair of cassette side conductive electrodes 81 overlaps the second discharge port 64 in the right-left direction. In contrast, according to the modified embodiment, the rear side one of the pair of cassette side conductive electrode 81 may overlap the second discharge port 64 in the right-left direction. Alternatively, none of the pair of cassette side conductive electrodes 81 may overlap the second discharge port 64 in the right-left direction. For example, a clearance between the two cassette side conductive electrodes 81 may overlap the second discharge port 64 in the right-left direction.

The substrate 80 may be configured such that a plurality of pairs of cassette side conductive electrodes 81 are provided thereto. According to the illustrative embodiment, the pair of cassette side conductive electrodes 81 and the pair of main body side conductive electrodes 34 are metallic electrodes. However, according to an modified embodiment, the electrodes are conductive resin electrodes. Optionally, in addition to the condensers 83, other electronic elements such as coils may be provided. It is preferable that such electronic elements are arranged in the second substrate area S2. In such a case, the electronic elements are arranged in the relief recess 72. Therefore, it is possible to suppress that the tape cassette 5 contacts the first wall 71 and the second wall 73, and is damaged by the electronic elements.

According to the above-described illustrative embodiment, the length, in the longer side direction, of the pair of cassette side conductive electrodes 81 is shorter than the length, in the longer side direction, of the pair of main body side conductive electrodes 34. Further, the length, in the shorter side direction, of the pair of cassette side conductive electrodes 81 is longer than the length, in the shorter side direction, of the pair of main body side conductive electrodes 34. The distance between the two cassette side conductive electrodes 81 is shorter than the distance between the two main body side conductive electrodes 34. In contrast, according to the modified embodiment, the length, in the longer side direction, of the pair of cassette side conductive electrodes 81 may be equal to or longer than the length, in the longer side direction, of the pair of main body side conductive electrodes 34. Further, the length, in the shorter side direction, of the pair of cassette side conductive electrodes 81 is equal to or shorter than the length, in the shorter side direction, of the pair of main body side conductive electrodes 34. The distance between the two cassette side conductive electrodes 81 is equal to or longer than the distance between the two main body side conductive electrodes 34.

The pair of cassette said conductive electrodes 81 has a rectangular shape elongated in the Y2 direction. According to an modified embodiment, the shape may be a rectangular shape elongated in the Y1 direction, or another shape such as a square or circular shape. The two cassette side conductive electrodes 81 have the same shapes and arranged in the Y1 direction. According to a modified embodiment, the two cassette side conductive electrodes 81 may be configured to have the same shapes. Alternatively, the two cassette side conductive electrodes 81 may be arranged in the Y1 direction by have different shaped, or may be arranged in the Y2 direction.

According to the above-described embodiment, the arrangement part 70 is recessed leftward from the right wall 55. However, according to a modified embodiment, the arrangement part 70 may not be recessed. That is, the first wall 71 and the second wall 73 may be arranged on the same position, in the right-left direction, as the particular surface 55A. According to the above-identified embodiment, the second discharge port 64, the arrangement part 70 and the substrate 80 area arranged in the third area R3. However, according to a modified embodiment, the second discharge port 64, the arrangement part 70 and the substrate 80 are arranged in the third area R3 may be arranged in the first area R1 or the second area R2, or arranged to be bridged among a plurality of areas (e.g., the first area R1, the second area R2 and the third area R3). Alternatively, the second discharge port 64, the arrangement part 70 and the substrate 80 may be arranged on the upper wall 53, the lower wall 54, the left wall 56, the front wall 57 or the rear wall 58.

According to the above-described embodiment, the hook 67A is provided to the rear wall 58 included in the upper case 51, and the hole 67B is formed on the rear wall 58 included in the lower case 52. In contrast, according to a modified embodiment, the hook 67A may be provided to the rear wall 58 included in the lower case 52, and the hole 67B may be formed on the rear wall 58 included in the upper case 51.

According to the above-described embodiment, the printer 1 is configured to receive a signal from the IC chip 82 in accordance with the modulation method. In contrast, according to a modified embodiment, the printer 1 may receive the signal from the IC chip 82 in accordance with another method (e.g., a differential signal output by the IC chip 82).

According to the above-described embodiment, the particular surface 55A and the first surface 80A area arranged at the same positions in the right-left direction. In contrast, according to a modified embodiment, the first surface 80A may be arranged on the left side with respect to the particular surface 55A. According to such a configuration, a state where a portion of the substrate 80 protruding rightward with respect to the particular surface 55A is caught and the substrate 80 comes out from the arrangement part 70 is suppressed. The first surface 80A may be arranged on the right side with respect to the particular surface 55A. In such a case, the substrate 80 is protruded rightward with respect to the particular surface 55A, when the tape cassette 5 is attached to the cassette attachment part 20, it is ensured that the pair of main body side conductive electrodes 34 contact the pair of cassette side conductive electrodes 81.

What is claimed is:

1. A tape cassette, comprising:

a box-like cassette case having a first outer wall, a second outer wall, a third outer wall, a fourth outer wall, a fifth outer wall and a sixth outer wall, the first outer wall and the second outer wall extending in parallel and being arranged in a first direction perpendicular to both the first outer wall and the second outer wall, the third outer wall and the fourth outer wall extending in parallel and being arranged in a second direction perpendicular to both the third outer wall and the fourth outer wall, the fifth outer wall and the sixth outer wall extending in parallel and being arranged in a third direction perpendicular to both the fifth outer wall and the sixth outer wall, the first direction, the second direction and the third direction are perpendicular to each other;

a tape configured to be accommodated in the cassette case; and a substrate having a first surface and a second surface opposite to the first surface, a pair of conductive electrodes being provided on the first surface, a storage being electrically connected to the pair of conductive electrodes, and the storage being provided on the second surface, wherein the third outer wall has a first side wall extending in parallel with the third outer wall, one of a recess and a hole being provided, the recess being recessed in a fourth direction, which is a one-way direction of the second direction directing inside the cassette case from the third outer wall, and the hole penetrating the cassette case in the second direction, and a second side wall extending in parallel with the third outer wall, the first side wall, the one of the recess and the hole, and the second side wall extending, in this order, along a fifth direction which is a one-way direction of the third direction, wherein the pair of conductive electrodes is arranged in a sixth direction which is parallel with the first surface, wherein the second surface is equally divided into three areas of a first substrate area, a second substrate area and a third substrate area, in this order, along a one-way direction of the sixth direction, wherein the storage is arranged in the second substrate area, wherein the second surface of the substrate faces the first side wall, the one of the recess and the hole and the second side wall, wherein the second surface of the substrate is arranged to be bridged between the first side wall and the second side wall with the third direction being the sixth direction, and wherein one of the storage and a molded part protecting the storage is arranged at the one of the recess and the hole.

2. The tape cassette according to claim 1, wherein a surface shape of a first arrangement area on a side in an eighth direction, which is a one-way direction of the first direction, of the first side wall and a surface shape of a second arrangement area on a side in a ninth direction which is a one-way direction opposite to the eighth direction in the second side wall are symmetrical with respect to a center, viewed along the second direction, of an area including the first side wall, the one of the recess and the hole and the second side wall, and wherein a surface shape of a third arrangement area on a side in the ninth direction of the first side wall and a surface shape of a fourth arrangement area of the second side wall on a side in the eighth direction are symmetrical with respect to the center.

3. The tape cassette according to claim 2, wherein a distance, in the third direction, between an end part of the first side wall opposite to the second side wall and an end part of the second side wall opposite to the first side wall is larger than a length of the substrate in the sixth direction, wherein a length of the one of the recess and the hole in the third direction is larger than a length of the one of the storage and the molded part in the sixth direction, and wherein:

a length, in the third direction, of the first side wall is smaller than a length, in the sixth direction, between one of the storage and the molded part and each end, in the sixth direction, of the substrate; and a length, in the third direction, of the second side wall is smaller than the length, in the sixth direction, between one of the storage and the molded part and each end, in the sixth direction, of the substrate.

4. The tape cassette according to claim 2, wherein surface shapes of the first arrangement area, the second arrangement area, the third arrangement area and the fourth arrangement area are substantially planar.

5. The tape cassette according to claim 2, wherein the first side wall and the second side wall are provided with at least one pair of protrusions which protrude from positions symmetrical with respect to the center, and wherein the second surface is provided with at least one pair of recesses or holes penetrating through the second surface at positions corresponding to the at least one pair of protrusions.

6. The tape cassette according to claim 1, further comprising a pair of condensers provided on the second surface and electrically connected to the pair of conductive electrodes, respectively, wherein the pair of condensers is arranged in the second substrate area.

7. The tape cassette according to claim 1, wherein one of a bottom wall of the recess, and the storage or the molded part arranged in the hole faces the tape inside the cassette case.

8. The tape cassette according to claim 7, wherein one of the bottom wall of the recess, and the storage or the molded part arranged in the hole faces the tape on a conveying passage of the tape inside the cassette case.

9. The tape cassette according to claim 7, further comprising a discharging part formed on the fourth outer wall to allow the tape to be discharged therefrom, wherein, given that the third outer wall and the fourth outer wall being equally divided, in the fifth direction, into a first area, a second area and a third area in this order, the discharging part and the one of the recess and the hole are arranged in the same one of the first area and the third area.

10. The tape cassette according to claim 1, wherein the third outer wall has a particular surface directed to a seventh direction opposite to the fourth direction, and wherein the first side wall and the second side wall are arranged such that:

a distance, in the second direction, between the fourth outer wall and the first side wall is smaller than a distance, in the second direction, between the fourth outer wall and the particular surface; and a distance, in the second direction, between the fourth outer wall and the second side wall is smaller than a distance, in the second direction, between the fourth outer wall and the particular surface.

11. The tape cassette according to claim 10, wherein the particular surface and the first surface are arranged at the same positions in the second direction.

12. The tape cassette according to claim 1, wherein a first distance between the fifth outer wall and the sixth outer wall is larger than a second distance between the first outer wall and the second outer wall, and wherein a third distance between the third outer wall and the fourth outer wall is larger than the first distance.

13. The tape cassette according to claim 1, further comprising a supporting part provided between the first outer wall and the second outer wall, the supporting part extending in the first direction, the supporting part supporting a tape roll configured by winding the tape.

14. The tape cassette according to claim 1, wherein the recess is recessed in the fourth direction from the first side wall and the second side wall.

15. The tape cassette according to claim 1, wherein the first side wall and the second side wall are arranged on the fourth direction with respect to the third outer wall.

16. The tape cassette according to claim 15, wherein the recess is recessed in the fourth direction from the first side wall and the second side wall.

17. The tape cassette according to claim 1, wherein the substrate has a rectangular shape.

18. A tape cassette configured to contain a tape, comprising:

a box-like cassette case having a wall formed with one of a recess and a hole; and a substrate having a first surface and a second surface opposite to the first surface, at least two conductive electrodes being provided on the first surface, a storage being electrically connected to the pair of conductive electrodes, and the storage being provided on the second surface, wherein the at least one of the recess and the hole is arranged at a central area, in a particular direction, of the wall, the wall having a first side wall and a second side wall, the first side wall being located on one side with respect to the at least one of the recess and the hole in the particular direction, the second side wall being located on the other side with respect to the at least one of the recess and the hole in the particular direction, and the substrate being attached on the wall such that:

the substrate is arranged at the one of the recess and the hole with the second surface of the substrate being bridged between the first side wall and the second side wall; and the at least two conductive electrodes are aligned in the particular direction regardless of whether the substrate is attached on the wall in a first orientation or a second orientation which is a reversed orientation with respect to the particular direction.

19. The tape cassette according to claim 18, further comprising a pair of condensers provided on the second surface and electrically connected to the pair of conductive electrodes, respectively, wherein the second surface of the substrate is equally divided into three areas of a first substrate area, a second substrate area and a third substrate area, in this order, along the specific direction, and wherein the storage and the pair of condensers are arranged in the second substrate area.

20. A tape cassette, comprising:

a box-like cassette case having a first outer wall, a second outer wall, a third outer wall, a fourth outer wall, a fifth outer wall and a sixth outer wall, the first outer wall and the second outer wall extending in parallel and being arranged in a first direction perpendicular to both the first outer wall and the second outer wall, the third outer wall and the fourth outer wall extending in parallel and being arranged in a second direction perpendicular to both the third outer wall and the fourth outer wall, the fifth outer wall and the sixth outer wall extending in parallel and being arranged in a third direction perpendicular to both the fifth outer wall and the sixth outer wall, the first direction, the second direction and the third direction are perpendicular to each other;

a tape configured to be accommodated in the cassette case;

a substrate having a first surface and a second surface opposite to the first surface, a pair of conductive electrodes being provided on the first surface, a storage being electrically connected to the pair of conductive electrodes, and the storage being provided on the second surface; and a pair of condensers provided on the second surface and electrically connected to the pair of conductive electrodes, respectively;

wherein the third outer wall has a first side wall extending in parallel with the third outer wall, one of a recess and a hole being provided, the recess being recessed in a fourth direction, which is a one-way direction of the second direction directing inside the cassette case from the third outer wall, and the hole penetrating the cassette case in the second direction, and a second side wall extending in parallel with the third outer wall, the first side wall, the one of the recess and the hole, and the second side wall extending, in this order, along a fifth direction which is a one-way direction of the third direction, wherein the pair of conductive electrodes is arranged in a sixth direction which is parallel with the first surface, wherein the second surface is equally divided into three areas of a first substrate area, a second substrate area and a third substrate area, in this order, along a one-way direction of the sixth direction, wherein the storage and the pair of condensers are arranged in the second substrate area, wherein the second surface of the substrate faces the first side wall, the one of the recess and the hole and the second side wall, wherein the substrate is arranged to be bridged between the first side wall and the second side wall with the third direction being the sixth direction, and wherein one of the storage and a molded part protecting the storage is arranged at the one of the recess and the hole.

* * * * *